US010947699B2

(12) United States Patent
Saitoh et al.

(10) Patent No.: US 10,947,699 B2
(45) Date of Patent: Mar. 16, 2021

(54) CONSTRUCTION MACHINE

(71) Applicant: Hitachi Construction Machinery Co., Ltd., Tokyo (JP)

(72) Inventors: Teppei Saitoh, Tokyo (JP); Takamasa Kai, Tokyo (JP); Kenji Hiraku, Tsuchiura (JP); Hiromasa Takahashi, Tsuchiura (JP); Juri Shimizu, Tsuchiura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 168 days.

(21) Appl. No.: 16/461,491

(22) PCT Filed: Feb. 6, 2018

(86) PCT No.: PCT/JP2018/004049
§ 371 (c)(1),
(2) Date: May 16, 2019

(87) PCT Pub. No.: WO2018/179863
PCT Pub. Date: Oct. 4, 2018

(65) Prior Publication Data

US 2019/0345692 A1 Nov. 14, 2019

(30) Foreign Application Priority Data

Mar. 30, 2017 (JP) ..... JP2017-068540

(51) Int. Cl.
*E02F 9/22* (2006.01)
*F15B 11/028* (2006.01)
(Continued)

(52) U.S. Cl.
CPC ..... *E02F 9/22* (2013.01); *E02F 9/2289* (2013.01); *E02F 9/2292* (2013.01);
(Continued)

(58) Field of Classification Search
CPC .... F15B 11/17; F15B 20/008; F15B 2211/36; F15B 2211/634; F15B 2211/6346; F15B 2211/87; E02F 9/2289; E02F 9/2292
See application file for complete search history.

(56) References Cited

U.S. PATENT DOCUMENTS 4,369,625 A * 1/1983 Izumi ..... E02F 9/2292 60/421
5,299,420 A * 4/1994 Devier ..... E02F 9/22 60/403
(Continued)

FOREIGN PATENT DOCUMENTS

JP 2015-48899 A 3/2015
JP 2016-114129 A 6/2016
(Continued)

OTHER PUBLICATIONS

International Preliminary Report on Patentability (PCT/IB/338 & PCT/IB/373) issued in PCT Application No. PCT/JP2018/004049 dated Oct. 10, 2019, including English translation of document C2 (Japanese-language Written Opinion (PCT/ISA/237) previously filed on May 16, 2019) six pages.
(Continued)

*Primary Examiner* — Michael Leslie
(74) *Attorney, Agent, or Firm* — Crowell & Moring LLP

(57) ABSTRACT

A construction machine incorporates a hydraulic closed circuit system capable of suppressing, even where a selector valve is stuck in an open state by a failure of the selector valve or a control system therefor, unintended operation of a hydraulic actuator and continuing operation of a machine body. The construction machine includes first sensors that detect open-closed states of a plurality of switching valves, first compulsory valve closing devices that change over the plurality of switching valves to a closed position irrespective of open-close control by a machine body controller, and a
(Continued)

valve device controller that controls, when it is detected based on the open-closed states of the plurality of selector values detected by the first sensors that one of the plurality of selector values is stuck in an open state, the first compulsory valve closing device such that other selector valve connected to one of the plurality of closed circuit pumps to which the one selector valve is connected is closed.

8 Claims, 18 Drawing Sheets

(51) Int. Cl.
*F15B 11/17* (2006.01)
*F15B 20/00* (2006.01)

(52) U.S. Cl.
CPC ..... *F15B 11/028* (2013.01); *F15B 11/17* (2013.01); *F15B 20/00* (2013.01); *F15B 20/008* (2013.01); *F15B 2211/36* (2013.01); *F15B 2211/40* (2013.01); *F15B 2211/634* (2013.01); *F15B 2211/6346* (2013.01); *F15B 2211/87* (2013.01)

(56) References Cited

U.S. PATENT DOCUMENTS

| | | | | |
|---|---|---|---|---|
| 8,910,474 | B2 * | 12/2014 | Knussman | E02F 9/2242 60/422 |
| 8,984,873 | B2 * | 3/2015 | Opdenbosch | E02F 9/2228 60/420 |
| 9,783,960 | B2 * | 10/2017 | Shimizu | E02F 9/2278 |
| 9,845,813 | B2 * | 12/2017 | Shimizu | E02F 9/2292 |
| 2013/0312399 | A1 * | 11/2013 | Hiraku | E02F 9/2217 60/422 |
| 2016/0032565 | A1 | 2/2016 | Shimizu et al. | |

FOREIGN PATENT DOCUMENTS

| | | | |
|---|---|---|---|
| JP | 2016-142285 | A | 8/2016 |
| JP | 2017-53386 | A | 3/2017 |

OTHER PUBLICATIONS

International Search Report (PCT/ISA/210) issued in PCT Application No. PCT/JP2018/004049 dated Apr. 17, 2018 with English translation (two (2) pages).
Japanese-language Written Opinion (PCT/ISA/237) issued in PCT Application No. PCT/JP2018/004049 dated Apr. 17, 2018 (four (4) pages).

* cited by examiner

FIG. 4

| NEUTRAL DETECTION SWITCHES 62a, 62b | SELECTOR VALVE 37 | SELECTOR VALVE 38 | DECISION BY FAILURE DECISION SECTION 33c | VALVE FULL-CLOSING SWITCH 50 |
|---|---|---|---|---|
| 0 | CLOSED | CLOSED | NORMAL | OPEN |
| 0 | OPEN (CLOSED) | CLOSED (OPEN) | FAILED | CLOSED |
| 0 | OPEN | OPEN | FAILED | CLOSED |
| 1 | OPEN (CLOSED) | CLOSED (OPEN) | NORMAL | OPEN |
| 1 | OPEN | OPEN | FAILED | CLOSED |
| 1 | CLOSED | CLOSED | FAILED | OPEN |

CONSTRUCTION MACHINE

TECHNICAL FIELD

The present invention relates to a hydraulic system for a construction machine, and particularly to a hydraulic system for a construction machine that uses a hydraulic closed circuit in which a hydraulic actuator is driven directly by a hydraulic pump.

BACKGROUND ART

In recent years, energy saving is an important development item in a construction machine such as a hydraulic excavator or a wheel loader. For energy saving of a construction machine, energy saving of a hydraulic system itself is important, and application of a hydraulic system that uses a hydraulic closed circuit in which a hydraulic pump and a hydraulic actuator are directly connected to each other such that hydraulic fluid is delivered and discharged between each other (such hydraulic system is hereinafter referred to as "hydraulic closed circuit system") is investigated. The hydraulic closed circuit is free from pressure loss by a control valve and is free also from flow rate loss because only a necessary flow rate is delivered by a pump. Also it is possible to regenerate position energy and energy upon deceleration of the hydraulic actuator. Therefore, by applying the hydraulic closed circuit system, energy saving of a construction machine can be implemented.

A hydraulic closed circuit system applied to a construction machine is disclosed, for example, in Patent Document 1 that describes a configuration that each of a plurality of hydraulic pumps is selectively connected to one of a plurality of hydraulic actuators by closed circuit connection through a selector valve to make composite operation and high-speed operation of the hydraulic actuator possible.

Meanwhile, Patent Document 2 discloses a technology that, in a hydraulic system for which a hydraulic open circuit in which a plurality of hydraulic actuators are connected to one hydraulic pump through a directional control valve (such hydraulic system is hereinafter referred to as "hydraulic open circuit system"), in the case where an abnormal state that a solenoid proportional valve is closed by a failure or another abnormal state that a controller is stopped occurs, it is made possible to drive the hydraulic actuator at a speed equal to or lower than that in a normal state by setting the delivery pressure of a hydraulic pressure source (pilot primary pressure) lower than a predetermined pressure by a variable relief valve and suppressing the stroke of a directional control valve.

PRIOR ART DOCUMENT

Patent Documents

Patent Document 1: JP-2015-048899-A
Patent Document 2: JP-2016-114129-A

SUMMARY OF THE INVENTION

Problem to be Solved by the Invention

In the hydraulic closed circuit system disclosed in Patent Document 1, a plurality of switching valves are open-close controlled by a controller (machine body controller) such that one of hydraulic actuators is coupled to one hydraulic pump through a line in response to a lever operation by a driver. Here, in the case where such a situation that a selector valve or a controller fails and two or more switching valves connected to a same hydraulic pump are opened simultaneously occurs, two or more actuators connected to the two or more switching valves that are opened simultaneously are connected to each other through the line. Here, in a hydraulic closed circuit, because hydraulic operating fluid is permitted to flow bidirectionally in a line, a check valve cannot be inserted in the line. Therefore, there is a subject that, if two or more switching valves are opened simultaneously, then since the hydraulic operating fluid flows from an actuator having a high pressure to another actuator having a low pressure, operation of the hydraulic actuator, which is not intended by the operator possibly occurs.

On the other hand, in the hydraulic open circuit system disclosed in Patent Document 2, in the case where a controller for controlling a solenoid proportional valve (machine body controller) fails, since the failure detection function of the solenoid proportional valve and the controlling function of the variable relief valve are lost, the directional control vale cannot be controlled to a closed state. Accordingly, even if the technology disclosed in Patent Document 2 is applied to the hydraulic closed circuit system disclosed in Patent Document 2, operation of the hydraulic actuator, which is not intended by the operator, cannot be suppressed.

The present invention has been made in view of such a subject as described above, and it is an object of the present invention to provide a construction machine that incorporates a hydraulic closed circuit system in which, even in the case where a selector valve is sticked in an open state by a failure of the selector valve or a control system therefor, unintended operation of the hydraulic actuator is suppressed and operation of the machine can be continued.

Means for Solving the Problem

In order to attain the subject described above, according to the present invention, there is provided a construction machine including a plurality of closed circuit pumps, a plurality of hydraulic actuators, a plurality of operation levers corresponding to the plurality of hydraulic actuators, a plurality of switching valves capable of connecting each of the plurality of closed circuit pumps to one of the plurality of hydraulic actuators by closed circuit connection, and a machine body controller that performs open-close control of the plurality of switching valves and flow-rate control of the plurality of closed circuit pumps in response to an operation of the plurality of operation levers. The construction machine includes a first sensor that detects open-closed states of the plurality of switching valves, a first compulsory valve closing device that changes over the plurality of switching valves to a closed position irrespective of the open-close control by the machine body controller, and a valve device controller that is configured to, when detecting based on the open-closed states of the plurality of switching valves that one selector valve of the plurality of switching valves is sticked at an open position against a command by the machine body controller, control the first compulsory valve closing device such that other switching valves except the one selector valve, the other switching valves being connected to one closed circuit pump of the plurality of closed circuit pumps, the one closed circuit pump being connected to the one selector valve, are closed.

With the present invention configured in such a manner as described above, in the case where one of the plurality of switching valves is sticked in an open state by a failure of the selector valve or a control system therefor, the other switching valves connected to one closed circuit pump to which the selector valve sticking in an open state is connected are closed compulsorily such that the two hydraulic actuators are not connected to each other through a line, and therefore, unintended operation of the hydraulic actuators can be suppressed and operation of the machine body can be continued.

Advantages of the Invention

With the present invention, also where a selector valve is sticked in an open state by a failure of a selector valve or a control system therefor, unintended operation of the hydraulic actuators can be suppressed and operation of the machine body can be continued.

BRIEF DESCRIPTION OF THE DRAWINGS

FIG. 4 is a view depicting an example of failure decision logic by a failure decision section of the valve device controller according to the first embodiment of the present invention.

MODES FOR CARRYING OUT THE INVENTION

Figure 1:
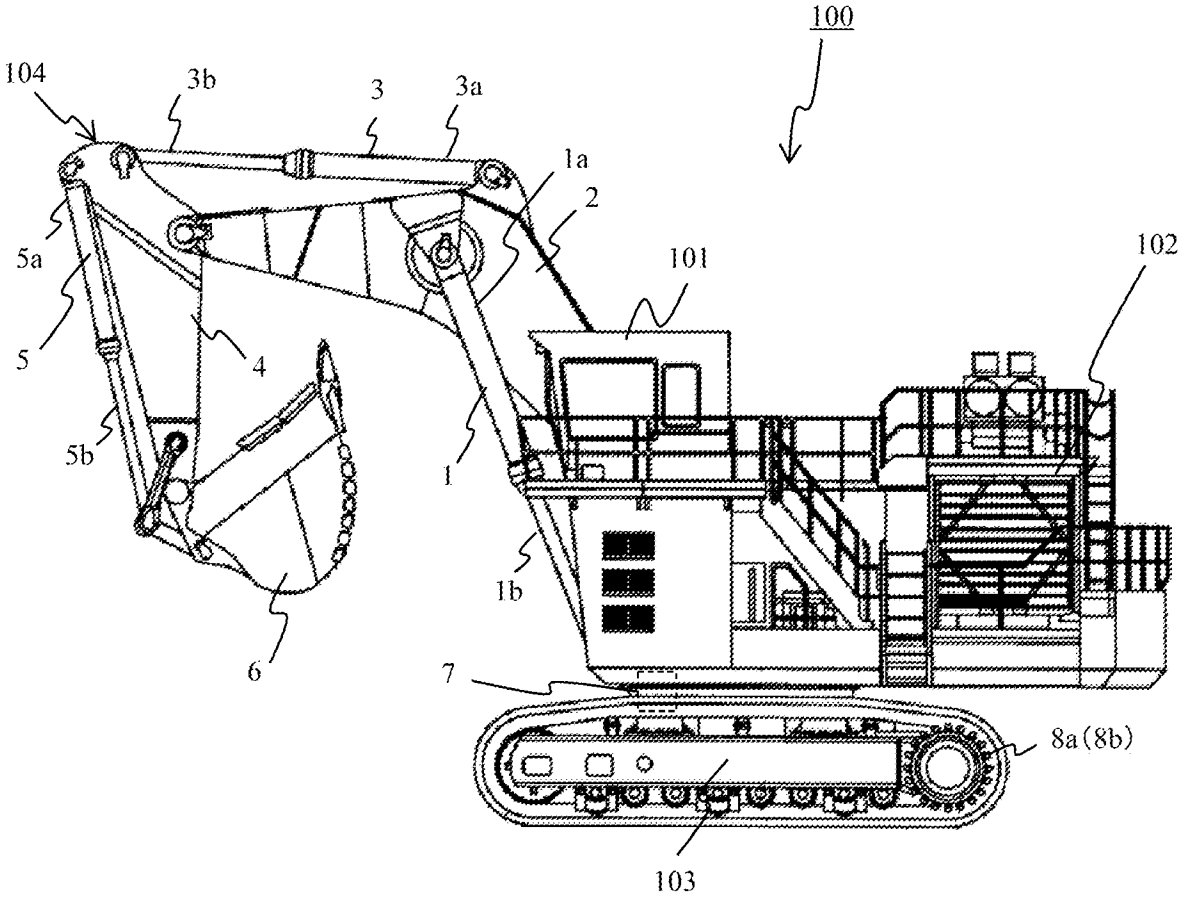
FIG. 1 is a side elevational view depicting a hydraulic excavator according to a first embodiment of the present invention.

In the following, embodiments of the present invention are described with reference to the drawings taking a large hydraulic excavator as an example of a construction machine. It is to be noted that, in the figures, like members are denoted by like reference characters and overlapping description is omitted suitably.

Embodiment 1

FIG. 1 is a side elevational view depicting a hydraulic excavator according to a first embodiment of the present invention.

Referring to FIG. 1, the hydraulic excavator 100 includes undercarriage 103 including track devices 8*a* and 8*b* of the crawler type on the opposite sides in the leftward and rightward direction, and an upper swing structure 102 as a main body attached swingably on the undercarriage 103. A cab 101 as an operation room an operator is to board is provided on the upper swing structure 102. The undercarriage 103 and the upper swing structure 102 are swingable through a swing motor 7 as a hydraulic actuator.

On the front side of the upper swing structure 102, a front work implement 104 that is an operating device for performing, for example, an excavating work is attached pivotably at a proximal end section thereof. Here, the front side signifies a direction in which an operator who boards the cab 101 is directed (leftward direction in FIG.

The front work implement 104 includes a boom 2 connected at a proximal end section thereof for elevation/depression movement to the front side of the upper swing structure 102. The boom 2 operates through a boom cylinder 1 that is a single rod type hydraulic cylinder. A cylinder rod 1*b* of the boom cylinder 1 is connected at a distal end section thereof to the upper swing structure 102, and a cylinder head 1*a* of the boom cylinder 1 is connected at a proximal end section thereof to the boom 2. To a distal end section of the boom 2, the arm 4 is connected at a proximal end section thereof pivotably in the upward and downward direction. The arm 4 operates through an arm cylinder 3 as a hydraulic actuator that is a single rod type hydraulic cylinder. A cylinder rod 3*b* of the arm cylinder 3 is connected at a distal end section thereof to the arm 4, and a cylinder head 3*a* of the arm cylinder 3 is connected at a proximal end section thereof to the boom 2. To a distal end section of the arm 4, a bucket 6 is connected at a base end section thereof pivotably in the upward and downward direction. The bucket 6 operates through a bucket cylinder 5 that is a single rod type hydraulic cylinder. A cylinder rod 5*b* of the bucket cylinder 5 is connected at a distal end section thereof to the bucket 6, and a cylinder head 5*a* of the bucket cylinder 5 is connected at a proximal end section thereof to the arm 4.

In the cab 101, a boom lever 34*a* (depicted in FIG. 2), an arm lever 34*b* (depicted in FIG. 2) and a bucket lever (not depicted) that are operation members for operating the boom 2, arm 4 and bucket 6 configuring the front work implement 104, respectively.

Figure 2:
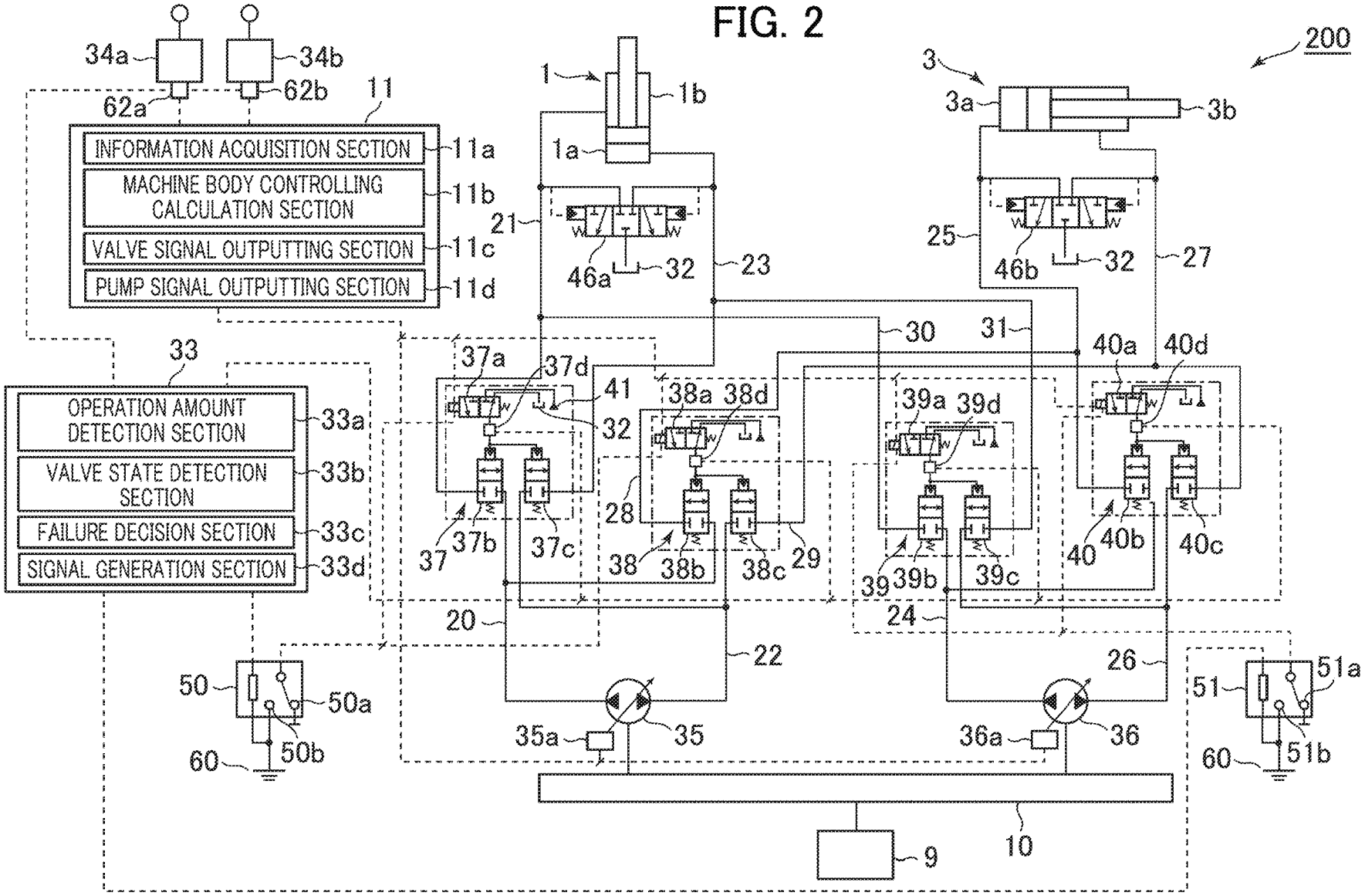
FIG. 2 is a schematic view depicting a configuration of a hydraulic system according to the first embodiment of the present invention.

FIG. 2 is a schematic view depicting a configuration of a hydraulic system incorporated in the hydraulic excavator 100. It is to be noted that, for simplified description, only portions relating to driving of the boom cylinder 1 and the arm cylinder 3 while portions relating to driving other hydraulic actuators are omitted.

Referring to FIG. 2, the hydraulic system 200 includes double-tilt type hydraulic pumps (each hereinafter referred to as "closed circuit pump") 35 and 36, a plurality of hydraulic actuators 1 and 3, a plurality of operation levers 34*a* and 34*b* corresponding to the plurality of hydraulic actuators, a plurality of switching valves 37 to 40 capable of connecting each of the closed circuit pumps 35 and 36 by closed circuit connection to one of the plurality of hydraulic actuators 1 and 3, a machine body controller 11 that performs open-close control of the plurality of switching valves 37 to 40 and flow-rate control of the plurality of closed circuit pumps 35 and 36 in response to an operation of the plurality of operation levers 34*a* and 34*b*, and a valve device controller 33 hereinafter described.

The closed circuit pumps 35 and 36 are driven by power received from an engine 9 through a transmission device 10. The closed circuit pumps 35 and 36 include a tilting swash plate mechanism (not depicted) having a pair of input/output ports as flow rate adjustment means, and regulators 35*a* and 36*a* that adjust the tilting angle of the swash plates to adjust the displacement volume. The regulators 35*a* and 36*a* control the delivery flow rate and the delivery direction of the closed circuit pumps 35 and 36 on the basis of pump delivery flow rate command values received from the machine body controller 11.

The switching valves 37 to 40 open or close in response to a control signal received from the machine body controller 11 to connect the closed circuit pumps 35 and 36 to the boom cylinder 1 or the arm cylinder 3 by closed circuit connect, respectively.

When the selector valve 37 is open, the other selector valve 38 connected to the same closed circuit pump 35 is closed, and one of delivery ports of the closed circuit pump 35 is connected to the cylinder rod 1*b* of the boom cylinder 1 through the lines 20 and 21 while the other delivery port is connected to the cylinder head 1*a* of the boom cylinder 1 through the lines 22 and 23, and the lines 10, 21, 23 and 24 form a closed circuit thereby. On the other hand, when the selector valve 38 is open, the other selector valve 37 connected to the same closed circuit pump 35 is closed, and one of the delivery ports of the closed circuit pump 35 is connected to the cylinder head 3*a* of the arm cylinder 3 through the lines 20, 28 and 25 while the other delivery port is connected to the cylinder rod 3*b* of the arm cylinder 3 through the lines 22, 29 and 27, and the lines 20, 28, 25, 27, 29 and 22 form a closed circuit.

Similarly, when the selector valve 40 is open, the other selector valve 39 connected to the same closed circuit pump 36 is closed, and one of delivery ports of the closed circuit pump 36 is connected to the cylinder head 3*a* of the arm cylinder 3 through the lines 24 and 25 while the other delivery port is connected to the cylinder rod 3*b* of the arm cylinder 3 through the lines 26 and 27, and the lines 24, 25, 27 and 26 form a closed circuit thereby. On the other hand, when the selector valve 39 is open, the other selector valve 40 connected to the same closed circuit pump 36 is closed, and one of the delivery ports of the closed circuit pump 36 is connected to the cylinder rod 1*b* of the arm cylinder 3 through the lines 24, 30 and 21 while the other delivery port is connected to the cylinder head 1*a* of the boom cylinder 1 through the lines 26, 31 and 23, and the lines 24, 30, 21, 23, 31 and 26 form a closed circuit.

The selector valve 37 includes a solenoid valve 37*a* and poppet valves 37*b* and 37*c*. The solenoid valve 37*a* is biased toward the closing side by spring force, and is opened or closed in response to a control signal (opening signal or closing signal) received from the machine body controller 11 to connect the pilot chamber of the poppet valves 37*b* and 37*c* to a pilot hydraulic fluid source 41 or a tank 32. In the case where a closing signal is inputted to the solenoid valve 37*a*, the pilot chamber of the poppet valves 37*b* and 37*c* is connected to the tank 32 and the pressure thereof becomes low, whereupon the poppet valves 37*b* and 37*c* are driven to the closing side by the spring force and the lines 20 and 21 and the lines 22 and 23 are disconnected from each other. In the case where an opening signal is inputted to the solenoid valve 37*a*, the pilot chamber of the poppet valves 37*b* and 37*c* is connected to the pilot hydraulic fluid source 41 and the pressure thereof becomes high, whereupon the poppet valves 37*b* and 37*c* are driven to the open side and the lines 20 and 21 and the lines 22 and 23 are placed into a communication state with each other. Since the switching valves 38 to 40 are similar to the selector valve 37, description of the same is mitted. It is to be noted that, while, in the present embodiment, a selector valve that drives a poppet valve using a pilot hydraulic source and a solenoid valve is used as an example, only a solenoid valve that opens and closes a line in accordance with an electric signal may be used for the configuration.

The machine body controller 11 is connected to the boom lever 34*a* and the arm lever 34*b* as operation levers through signal lines and is connected to the solenoid valves 37*a* to 40*a* of the switching valves 37 to 40 through control signal lines.

The machine body controller 11 includes an information acquisition section 11*a*, a machine body controlling calculation section 11*b*, a valve signal outputting section 11*c* and a pump signal outputting section 11*d*. The information acquisition section 11*a* detects an operation amount of the boom lever 34*a* and the arm lever 34*b*.

The machine body controlling calculation section 11*b* determines connection between the closed circuit pumps 35 and 36 and the boom cylinder 1 and arm cylinder 3 on the basis of an operation amount of the boom lever 34*a* and the arm lever 34*b*. In this state, for example, in the case where the operation amount of the boom lever 34*a* is equal to or smaller than one half a maximum operation amount, the machine body controlling calculation section 11*b* determines to open the selector valve 37 and close the selector valve 38 such that only the closed circuit pump 35 is connected to the boom cylinder 1 and sets the pump delivery flow rate command value for the closed circuit pump 35 to a value according to the operation amount of the boom lever 34*a*. On the other hand, in the case where the operation amount of the boom lever 34*a* exceeds one half the maximum operation amount, the machine body controlling calculation section 11*b* determines to open the switching valves 37 and 39 such that the closed circuit pumps 35 and 36 are connected to the boom cylinder 1 and sets the pump delivery flow rate command values for the closed circuit pumps 35 and 36 to a value according to the operation amount of the boom lever 34*a*. In the case where the boom lever 34*a* and the arm lever 34*b* are operated, the machine body controlling calculation section 11*b* determines to open the switching valves 37 and 40 and close the switching valves 38 and 39 such that the closed circuit pump 35 is connected to the boom cylinder 1 and besides the closed circuit pump 36 is connected to the arm cylinder 3 and sets the pump delivery flow rate command values for the closed circuit pumps 35 and 36 according to the operation amounts of the boom lever 34*a* and of the arm lever 34*b*, respectively. The delivery directions of the closed circuit pumps 35 and 36 are determined by the operation directions of the boom lever 34*a* and the arm lever 34*b*.

The valve signal outputting section 11*c* outputs control signals to the switching valves 37 to 40 on the basis of the opening/closing information for the switching valves 37 to 40 determined by the machine body controlling calculation section 11*b* to control opening/closing of the selector values 37 to 40. The pump signal outputting section 11*d* outputs control signals to the regulators 35*a* and 36*a* on the basis of the pump delivery flow rate command values set by the machine body controlling calculation section 11*b* to control the delivery flow rate and the delivery direction of the closed circuit pumps 35 and 36.

A flushing valve 46*a* is connected to the lines 21 and 23 and connects one of the lines 21 and 23 having a lower pressure to the tank 32. Meanwhile, another flushing valve 46*b* is connected to the lines 25 and 27 and connects one of the lines 25 and 27 having a lower pressure to the tank 32. Each of the flushing valves 46*a* and 46*b* has a function for discharging surplus hydraulic operating fluid of the respective closed circuit and a function for sucking insufficient hydraulic operating fluid of the closed circuit from the tank 32.

Now, a configuration relating to the present invention in the present embodiment is described.

In the switching valves 37 to 40, first to fourth pilot pressure sensors 37*d* to 40*d* are provided as first open-close sensor for detecting respective open-closed states. The first to fourth pilot pressure sensors 37*d* to 40*d* are connected to the valve device controller 33 by signal lines. For example, if description is given taking the selector valve 37 as an example, the pilot pressure sensor 37*d* is provided in a line that connects the solenoid valve 37*a* and the poppet valves 37*b* and 37*c* and detects a pilot pressure outputted from the solenoid valve 37*a*. When a closing signal is inputted to the solenoid valve 37*a*, since the pilot pressure sensor 37*d* is connected to the tank 32, a low pressure of the pilot pressure sensor 37*d* is detected. On the other hand, when an opening signal is inputted to the solenoid valve 37*a*, since the pilot pressure sensor 37*d* is connected to the pilot hydraulic fluid source 41, a high pressure of the pilot pressure sensor 37*d* is detected. Also in the switching valves 38 to 40, the second to fourth pilot pressure sensors 38*d* to 40*d* are provided in similar lines, respectively. It is to be noted that, although, in the present embodiment, the first sensor is configured from the first to fourth pilot pressure sensors 37*d* to 40*d*, for example, in the case where each selector valve is a solenoid valve, the first sensor may be configured from a stroke sensor or the like that measures the amount of movement of the valve body of the solenoid valve.

The boom lever 34*a* and the arm lever 34*b* have first and second neutral detection switches 62*a* and 62*b* provided therefor, respectively. The first and second neutral detection switches 62*a* and 62*b* detect a non-operational state (neutral) or an operational state (non-neutral) of the boom lever 34*a* and the arm lever 34*b*. In the case where each of the boom lever 34*a* and the arm lever 34*b* is neutral, the first and second neutral detection switches 62*a* and 62*b* output 0. On the other hand, in the case where each of the boom lever 34*a* and the arm lever 34*b* is non-neutral, the first and second neutral detection switches 62*a* and 62*b* output 1.

The valve device controller 33 is connected to the first and second neutral detection switches 62*a* and 62*b* and the first to fourth pilot pressure sensors 37*d* to 40*d* through signal lines and is connected to the first and second valve fully closing switches 50 and 51 through control signals. The valve device controller 33 includes an operation amount detection section 33*a*, a valve state detection section 33*b*, a failure decision section 33*c* and a signal generation section 33*d*.

Figure 3:
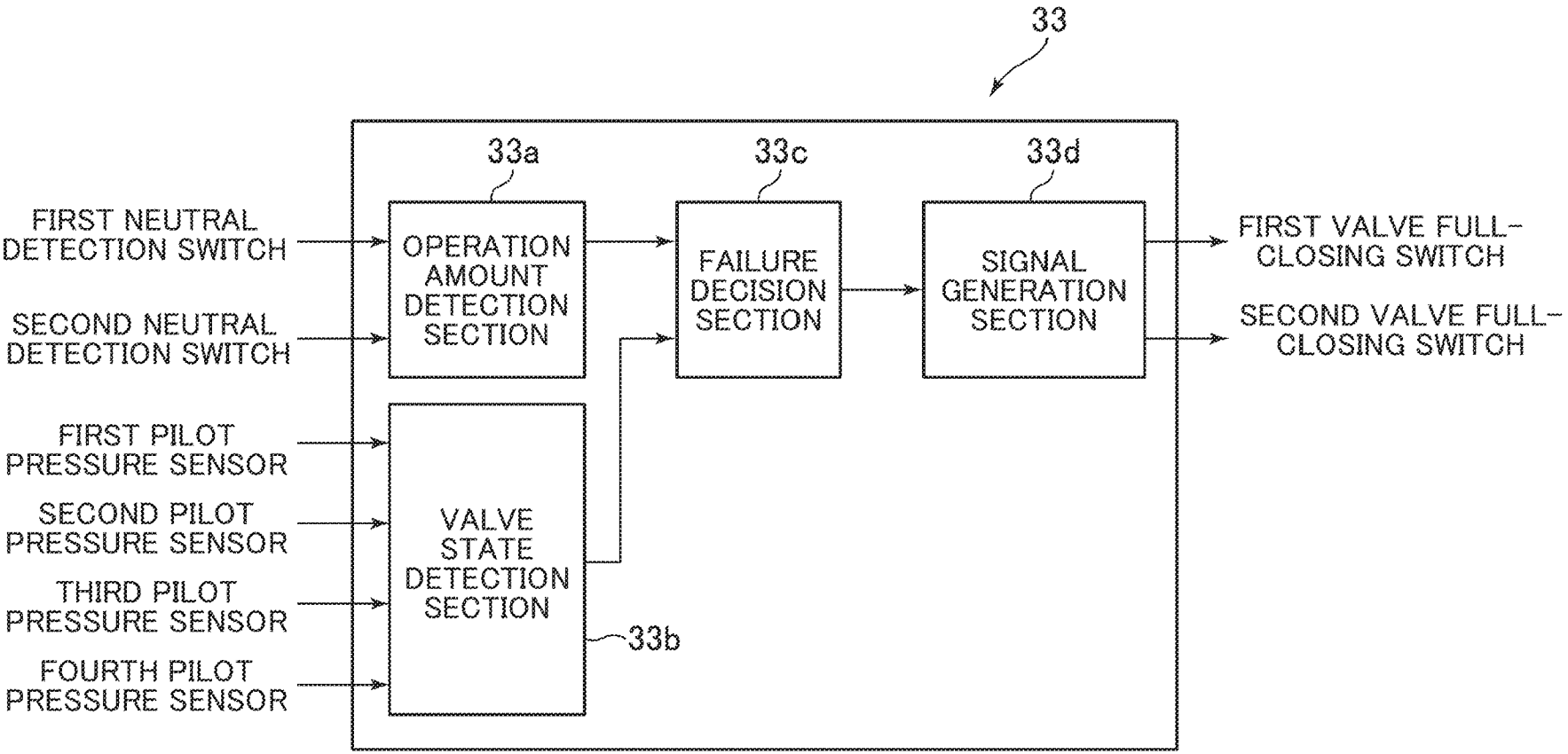
FIG. 3 is a block diagram depicting a configuration of a valve device controller according to the first embodiment of the present invention.

FIG. 3 is a block diagram depicting a configuration of the valve device controller 33.

Referring to FIG. 3, the operation amount detection section 33*a* detects an operation (non-neutral) state or a non-operation (neutral) state of the boom lever 34*a* and the arm lever 34*b* from the first and second neutral detection switches 62*a* and 62*b*. The valve state detection section 33*b* detects a pressure of the first to fourth pilot pressure sensors 37*d* to 40*d*. The failure decision section 33*c* decides a failure of the switching valves 37 to 40 on the basis of information from the operation amount detection section 33*a* and the valve state detection section 33*b*. Details of the decision method by the failure decision section 33*c* are hereinafter described. The signal generation section 33*d* outputs a control signal (opening signal or closing signal) to the first and second valve fully closing switches 50 and 51 on the basis of a result of decision from the failure decision section 33*c*.

FIG. 4 is a view depicting an example of failure decision logic by the failure decision section 33*c* of the valve device controller 33 and illustrates a corresponding relationship of outputs of the first and second neutral detection switches 62*a* and 62*b*, open-closed states of the switching valves 37 and 38 detected by the pilot pressure sensors 37*d* to 38*d*, decision results by the failure decision section 33*c* and control command values of the first valve fully closing switch 50 in a table.

Referring to FIG. 4, a case in which the boom lever 34*a* and the arm lever 34*b* are in a non-operation (neutral) state is described. If both of the outputs of the first and second neutral detection switches 62*a* and 62*b* are 0 and both of the switching valves 37 and 38 are closed, then the failure decision section 33*c* decides that the switching valves 37 and 38 are normal and sets the control command value for the first valve fully closing switch 50 to opening. Then, if both of the outputs of the first and second neutral detection switches 62*a* and 62*b* are 0 and at least one of the switching valves 37 and 38 is open, then although the boom lever 34*a* and the arm lever 34*b* are in a non-operation state, since at least one of the switching valves 37 and 38 is open, the failure decision section 33*c* decides that at least one of the switching valves 37 and 38 is in failure and sets the control command value for the first valve fully closing switch 50 to closing.

Now, a case in which at least one of the boom lever 34*a* and the arm lever 34*b* is operated is described. In the case where at least one of outputs of the first and second neutral detection switches 62*a* and 62*b* is 1 and only one of the switching valves 37 and 38 is open, the failure decision section 33*c* decides that the switching valves 37 and 38 are normal and sets the control command value for the first valve fully closing switch 50 to opening. On the other hand, in the case where one of outputs of the first and second neutral detection switches 62*a* and 62*b* is 1 and both of the switching valves 37 and 38 are open, the failure decision section 33*c* decides that at least one of the switching valves 37 and 38 is in failure and sets the control command value for the first valve fully closing switch 50 to closing. Further, in the case where at least one of outputs of the first and second neutral detection switches 62*a* and 62*b* is 1 and both of the switching valves 37 and 38 are closed, the failure decision section 33*c* decides that at least one of the switching valves 37 and 38 is in failure. However, if both of the switching valves 37 and 38 are closed, then since unintended operation of the hydraulic actuators 1 and 3 does not occur, the failure decision section 33*c* sets the control command value for the first valve fully closing switch 50 to opening.

Figure 5:
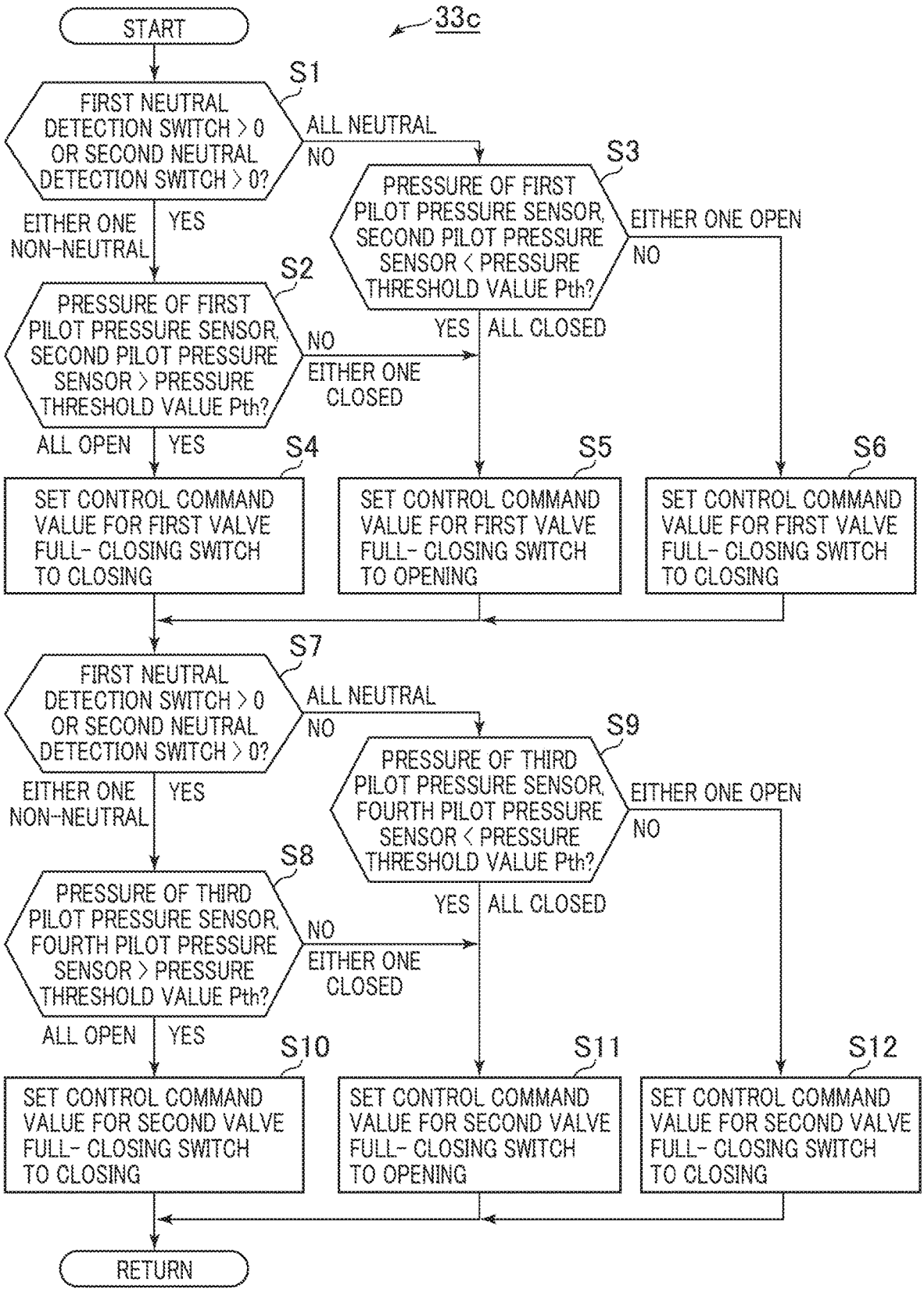
FIG. 5 is a flow chart depicting a process by the failure decision section of the valve device controller according to the first embodiment of the present invention.

FIG. 5 is a flow chart depicting processing by the failure decision section 33*c* of the valve device controller 33. It is to be noted that the processing by the failure decision section 33*c* depicted in FIG. 5 is preferably started immediately before a lever operation becomes effective (for example, immediately after a safety lever (not depicted) is cancelled after the engine 9 is started).

Referring to FIG. 5, in the case where the failure decision section 33*c* decides at step S1 that one of the outputs of the first and second neutral detection switches 62*a* and 62*b* is greater than 0 (namely, the boom lever 34*a* or the arm lever 34*b* is operated) (Yes), then the processing advances to step S2, but in the case where the failure decision section 33*c* decides that both of the outputs of the first and second neutral detection switches 62*a* and 62*b* are equal to or smaller than 0 (namely, none of the boom lever 34*a* and the arm lever 34*b* is operated) (No), the processing advances to step S3.

In the case where it is decided at step S2 that both of the pressures of the first and second pilot pressure sensors 37*d* and 38*d* are higher than a pressure threshold value (predetermined pressure) Pth (Yes), since the switching valves 37 and 38 are open simultaneously and unintended operation of the hydraulic actuators 1 and 3 possibly occurs, the control command value for the first valve fully closing switch 50 is set to closing at step S4. On the other hand, in the case where at least one of the pressures of the first and second pilot pressure sensors 37*d* and 38*d* is lower than the pressure threshold value Pth set in advance (No), since at least one of the switching valves 37 and 38 is closed and no unintended operation of the hydraulic actuators 1 and 3 occurs, the control command value for the first valve fully closing switch 50 is set to opening at step S5. Here, it is sufficient if the pressure threshold value Pth at step S2 is set to a value between the highest pressure (pressure of the pilot hydraulic fluid source 41 depicted in FIG. 2) and the lowest pressure (pressure of the tank 32 depicted in FIG. 2) that act in the spring chamber of the poppet valve of each selector valve. Meanwhile, as another example, it is sufficient if the selector valve is configured such that it introduces the highest pressure between the pressures across the poppet valve to the pilot chamber such that it is utilized as force for closing the poppet valve and, in the case where the highest pressure fluctuates depending upon the load to the hydraulic actuator, the lowest pressure where the highest pressure fluctuates is set as the pressure threshold value Pth.

In the case where it is decided at step S3 that both of the pressures of the first and second pilot pressure sensors 37*d* and 38*d* are lower than the pressure threshold value Pth (Yes), since both of the switching valves 37 and 38 are closed and unintended operation of the hydraulic actuators 1 and 3 does not occur, the control command value for the first valve fully closing switch 50 is set to opening at step S5. On the other hand, in the case where it is decided that at least one of the pressures of the first and second pilot pressure sensors 37*d* and 38*d* is higher than the pressure threshold value Pth set in advance (No), since, although none of the boom lever 34*a* and the arm lever 34*b* is operated, one of the switching valves 37 and 38 is open and unintended operation of the hydraulic actuators 1 and 3 possibly occurs, the control command value for the first valve fully closing switch 50 is set to closing at step S6.

In the case it is decided at step S7 after one of steps S4 to S6 is executed that one of the outputs of the first and second neutral detection switches 62*a* and 62*b* is greater than 0 (namely, the boom lever 34*a* or the arm lever 34*b* is operated) (Yes), the processing advances to step S8, but in the case where both of the outputs of the first and second neutral detection switches 62*a* and 62*b* are equal to or smaller than 0 (namely, none of the boom lever 34*a* and the arm lever 34*b* is operated) (No), then the processing advances to step S9.

In the case where it is decided at step S8 that the pressures of third and fourth pilot pressure sensors 39*d* and 40*d* are higher than the pressure threshold value Pth set in advance (Yes), since the switching valves 39 and 40 are open simultaneously and unintended operation of the hydraulic actuators 1 and 3 can possibly occur, the control command value for the second valve fully closing switch 51 is set to closing at step S10. On the other hand, in the case where it is decided that at least one of the pressures of the third and fourth pilot pressure sensors 39*d* and 40*d* is lower than the pressure threshold value Pth set in advance (No), since at least one of the switching valves 39 and 40 is closed and unintended operation of the hydraulic actuators 1 and 3 does not occur, the control command value for the second valve fully closing switch 51 is set to opening at step S11.

In the case where it is decided at step S9 that the pressures of the third and fourth pilot pressure sensors 39*d* and 40*d* are lower than the pressure threshold value Pth set in advance (Yes), since both of the switching valves 39 and 40 are closed and unintended operation of the hydraulic actuators 1 and 3 does not occur, the control command value for the second valve fully closing switch 51 is set to opening at step S11. On the other hand, in the case where it is decided that at least one of the pressures of the third and fourth pilot pressure sensors 39*d* and 40*d* is higher than the pressure threshold value Pth set in advance (No), since, although none of the boom lever 34*a* and the arm lever 34*b* is operated, one of the switching valves 39 and 40 is open and unintended operation of the hydraulic actuators 1 and 3 can possibly occur, the control command value of the second valve fully closing switch 51 is set to closing at step S12.

After one of steps S10 to S12 is executed, the processing returns to step S1 and the processes at the steps beginning with step S1 are executed repetitively.

Referring to FIG. 2, the first valve fully closing switch 50 is connected to the valve device controller 33 and the solenoid valves 37*a* and 38*a* through control signal lines and has a switching function between an open side contact 50*a* connected to nothing and a ground side contact 50*b* connected to the ground 60. Meanwhile, the second valve fully closing switch 51 is connected to the valve device controller 33 and the solenoid valves 39*a* and 40*a* through control signal lines and has switching function between an open side contact 51*a* connected to nothing and a ground side contact 51*b* connected to the ground 60. While, in the present embodiment, the first and second valve fully closing switches 50 and 51 are configured from an electric contact relay, they are not limited to a relay only if a similar function is available.

The first valve fully closing switch 50 connects the control signal lines from the solenoid valves 37*a* and 38*a* to the open side contact 50*a* or the ground side contact 50*b* in response to a control signal from the valve device controller 33. Meanwhile, the second valve fully closing switch 51 connects the control signal lines from the solenoid valves 39*a* and 40*a* to the open side contact 51*a* or the ground side contact 51*b* in response to a control signal from the valve device controller 33. In particular, when an opening signal from the valve device controller 33 is received, the first and second valve fully closing switches 50 and 51 connect the control signal lines from the solenoid valves 37*a* to 40*a* to the ground side contacts 50*b* and 51*b*, respectively, but when a closing signal is received, the first and second valve fully closing switches 50 and 51 connect the control signal lines to the open side contacts 50*a* and 51*a*, respectively. For example, if, in a state in which an opening signal is outputted from the machine body controller 11 to the solenoid valve 37*a*, the first valve fully closing switch 50 is connected to the ground side contact 50*b* in response to an opening signal from the valve device controller 33, then the control signal is transmitted from the machine body controller 11 to the solenoid valve 37*a*. Consequently, the solenoid valve 37*a* is driven to the open side and is opened to open the selector valve 37 (poppet valves 37*b* and 37*c*). On the other hand, if the first valve fully closing switch 50 is connected to the open side contact 50*a* in response to a closing signal from the valve device controller 33, then the control signal from the machine body controller 11 is not transmitted to the solenoid valve 37*a*. Consequently, the solenoid valve 37*a* is not driven to the open side but is closed by the spring force to close the selector valve 37 (poppet valves 37*b* and 37*c*). In this manner, the first and second valve fully closing switches 50 and 51 configure a first compulsory valve closing device for switching the switching valves 37 to 40 to their closed position irrespective of open-close control of the machine body controller 11.

Now, operation of the hydraulic system 200 is described.

First, operation of the hydraulic system 200 in the case where the switching valves 37 to 40 and the machine body controller 11 function normally is described.

Referring to FIG. 2, if an operator operates only the boom lever 34*a* within a range equal to or greater than one half the maximum operation amount to give an input for driving the boom cylinder 1 to extend, then the information acquisition section 11*a* of the machine body controller 11 detects the operation amount of the boom lever 34*a*. The machine body controlling calculation section 11*b* sets the control command value for the switching valves 37 and 39 to opening and set the control command value for the switching valves 38 and 40 to closing on the basis of the operation amount of the boom lever 34*a* and sets the pump delivery flow rate command value for the closed circuit pumps 35 and 36 to a value according to the operation amount of the boom lever 34*a*, such that the closed circuit pumps 35 and 36 are connected to the boom cylinder 1.

The valve signal outputting section 11*c* outputs, on the basis of the control command values for the switching valves 37 to 40 from the machine body controlling calculation section 11*b*, an opening signal to the switching valves 37 and 39 and outputs a closing signal to the switching valves 38 to 40. The pump signal outputting section 11*d* outputs a control signal to the regulators 35*a* and 36*a* of the closed circuit pumps 35 and 36 on the basis of the pump delivery flow rate command values from the machine body controlling calculation section 11*b*.

The closed circuit pumps 35 and 36 deliver hydraulic operating fluid at delivery flow rates set by the regulators 35*a* and 36*a* to the lines 20 and 24, respectively. Further, since the solenoid valves 37*a* and 39*a* of the switching valves 37 and 39 are opened in accordance with the opening signal, the poppet valves 37*b*, 37*c*, 39*b* and 39*c* are opened. On the other hand, since the solenoid valves 38*a* and 40*a* of the switching valves 38 and 40 are closed in response to the closing signal, the poppet valves 38*b*, 38*c*, 40*b* and 40*c* are closed. The hydraulic operating fluid delivered from the closed circuit pump 35 flows to the line 21 through the line 20 and the poppet valve 37*b* of the selector valve 37. Meanwhile, the hydraulic operating fluid delivered from the closed circuit pump 36 flows to the line 21 through the line 24, selector valve 39 (poppet valve 39*b*) and line 30. The hydraulic operating fluid from the closed circuit pump 35 and the hydraulic operating fluid from the closed circuit pump 36 merge in the line 21 and flow into the cylinder head 1*a* of the boom cylinder 1 to extend the boom cylinder 1. Part of the hydraulic operating fluid discharged from the cylinder rod 1*b* of the boom cylinder 1 is sucked into the closed circuit pump 35 through the line 23, selector valve (poppet valve 37*b*) and line 22. Meanwhile, the remaining part of the hydraulic operating fluid discharged from the cylinder rod 1*b* of the boom cylinder 1 is sucked into the closed circuit pump 36 through the line 31 selector valve 39 (poppet valve 39*b*) and line 24. At this time, an excess or deficient amount of the hydraulic operating fluid, which appears in each closed circuit, is supplied to or discharged from the tank 32 through the flushing valve 46*a*.

Referring to FIG. 2, since only the boom lever 34*a* is operated, the first neutral detection switch 62*a* outputs 1 and the second neutral detection switch 62*b* outputs 0.

Referring to FIG. 3, the operation amount detection section 33*a* of the valve device controller 33 detects signals of the first and second neutral detection switches 62*a* and 62*b*. Further, the valve state detection section 33*b* detects a high pressure of the first and third pilot pressure sensors 37*d* and 39*d* in response to opening of the solenoid valves 37*a* and 39*a* and detects a low pressure of the second and fourth pilot pressure sensors 38*d* and 40*d* in response to closing of the solenoid valves 38*a* and 40*a*.

Referring to FIG. 5, the failure decision section 33*c* executes steps S1, S2, S5, S7, S8 and S11 in this order and sets the control command values for the first and second valve fully closing switches 50 and 51 to opening.

Referring to FIG. 3, the signal generation section 33*d* of the valve device controller 33 outputs an opening signal to the first and second valve fully closing switches 50 and 51 on the basis of control command values for the first and second valve fully closing switches 50 and 51 set by the failure decision section 33*c*.

Referring to FIG. 2, the first valve fully closing switch 50 receives the opening signal from the valve device controller 33 to connect the control signal lines from the solenoid valves 37*a* and 38*a* to the ground side contact 50*b*. Meanwhile, the second valve fully closing switch 51 receives the opening signal from the valve device controller 33 to connect the control signal lines from the solenoid valves 39*a* and 40*a* to the ground side contact 51*b*. Consequently, the conduction state of the control signal lines is maintained to enable the control signals from the machine body controller 11 to the switching valves 37 to 40, and the open state of the switching valves 37 and 39 and the closed state of the switching valves 38 and 40 are maintained.

Figure 6:
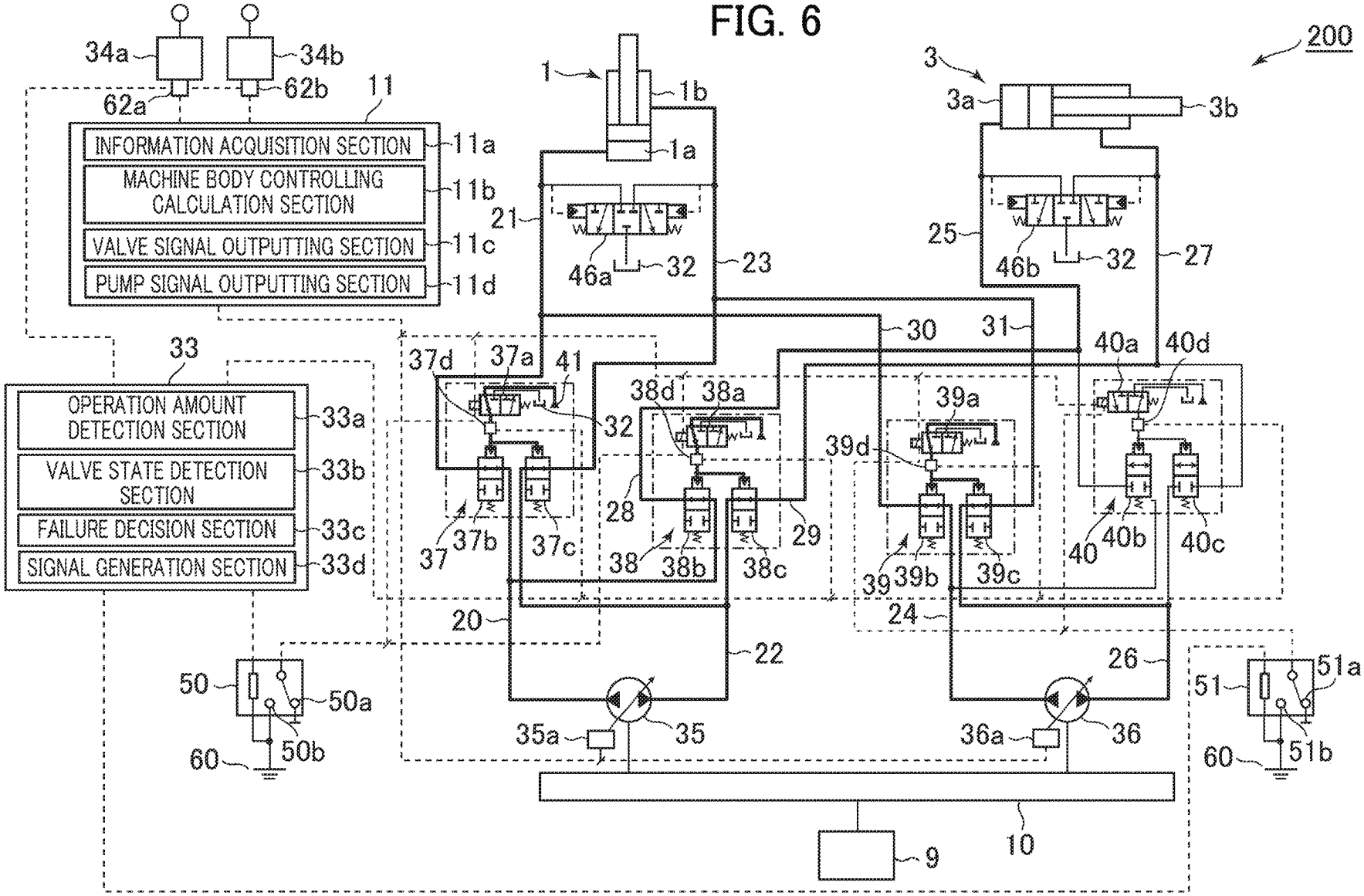
FIG. 6 is a view indicating a flow of hydraulic operating fluid by a thick line in the case where a selector valve is sticked in an open state in the hydraulic system according to the first embodiment of the present invention.

Now, operation of the hydraulic system 200 in the case where the selector valve 38 is sticked in an open state is described principally with reference to FIG. 6. FIG. 6 is a view in which a flow of hydraulic operating fluid in the case where the selector valve 38 is sticked in an open state in the hydraulic system 200 is indicated by a thick line.

Referring to FIG. 6, if an operator operates only the boom lever 34*a* within a range equal to or greater than one half the maximum operation amount to provide an input to drive the boom cylinder 1 to extend, then the information acquisition section 11*a* of the machine body controller 11 detects the operation amount of the boom lever 34*a*. On the basis of the operation amount of the boom lever 34*a*, the machine body controlling calculation section 11*b* sets the control command value for the switching valves 37 and 39 to opening and sets the control command value for the selector values 38 and 40 to closing such that the closed circuit pumps 35 and 36 are connected to the boom cylinder 1 and besides sets the pump delivery flow rate command value for the closed circuit pumps 35 and 36 to values according to the operation amount of the boom lever 34*a*.

The valve signal outputting section 11*c* outputs an opening signal to the switching valves 37 and 39 and outputs a closing signal to the switching valves 38 and 40 on the basis of the control command values for the switching valves 37 to 40 from the machine body controlling calculation section 11*b*. The pump signal outputting section 11*d* outputs control signals to the regulators 35*a* and 36*a* of the closed circuit pumps 35 and 36 on the basis of the delivery flow rate command value from the machine body controlling calculation section 11*b*.

The closed circuit pumps 35 and 36 deliver hydraulic operating fluid to the lines 20 and 24 at delivery flow rates controlled by the regulators 35*a* and 36*a*, respectively. It is assumed that, at this time, the selector valve 38 fails and is sticked in an open state. In other words, it is assumed that, although a closing signal is inputted from the machine body controlling calculation section 11*b*, the solenoid valve 38*a* does not close and the poppet valves 38*b* and 38*c* remain open. Here, since the selector valve 37 is open in accordance with the opening signal from the machine body controller 11, as a result of the sticking in an open state of the selector valve 38, the switching valves 37 and (poppet valves 37*b*, 37*c*, 38*b*, 38*c*) are opened simultaneously. Consequently, the cylinder head 1*a* of the boom cylinder 1 is connected to the cylinder head 3*a* of the arm cylinder 3 through the lines 21, 20, 28 and 25 and the cylinder rod 1*b* of the boom cylinder 1 is connected to the cylinder rod 3*b* of the arm cylinder 3 through the lines 23, 22, 29 and 27. If, in this state, a load, for example, in the contracting direction acts upon the boom cylinder 1, then the hydraulic operating fluid of the cylinder head 1*a* of the boom cylinder 1 flows out due to the load and flows into the cylinder head 3*a* of the arm cylinder 3 through the lines 21, 20, 28 and 25. As a result, although the arm lever 34*b* is not operated, the arm cylinder 3 extends.

In FIG. 6, since only the boom lever 34*a* is operated, the first neutral detection switch 62*a* outputs 1 and the second neutral detection switch 62*b* outputs 0.

Referring to FIG. 3, the operation amount detection section 33*a* of the valve device controller 33 detects signals of the first and second neutral detection switches 62*a* and 62*b*. Further, the valve state detection section 33*b* detects a high pressure of the first and third pilot pressure sensors 37*d* and 39*d* from opening of the solenoid valves 37*a* and 39*a* and detects a low pressure of the fourth pilot pressure sensor 40*d* from closing of the solenoid valve 40*a*. Further, since the solenoid valve 38*a* is sticked in an open state, the valve state detection section 33*b* detects a high pressure of the second pilot pressure sensor 38*d*.

Referring to FIG. 5, the failure decision section 33*c* executes steps S1 and S2 in this order. Here, since both of the pressures of the pilot pressure sensors 37*d* and 38*d* are high, the failure decision section 33*c* decides at step S2 that both of the pressures of the first and second pilot pressure sensors 37*d* and 38*d* are higher than the pressure threshold value Pth (Yes), and sets the control command value for the first valve fully closing switch 50 to closing at step S4. Thereafter, steps S7, S8 and S11 are executed in this order to set the control command value for the second valve fully closing switch 51 to opening.

In FIG. 3, the signal generation section 33*d* of the valve device controller 33 outputs a closing signal to the first valve fully closing switch 50 and outputs an opening signal to the second valve fully closing switch 51 on the basis of the control command values for the first and second valve fully closing switches 50 and 51 set by the failure decision section 33*c*.

Referring to FIG. 2, the first valve fully closing switch 50 receives the closing signal from the valve device controller 33 and connects the control signal lines from the solenoid valves 37*a* and 38*a* to the open side contact 50*a*. Consequently, since the control signal from the machine body controller 11 to the selector valve 37 is disabled, the solenoid valve 37*a* is not driven to the open side but is closed by the spring force to close the selector valve 37 (poppet valves 37*b* and 37*c*). As a result, the state in which the boom cylinder 1 and the arm cylinder 3 are connected to each other through the lines 21, 20, 28 and 25 and the lines 23, 22, 29 and 27 by the sticking in an open state of the selector valve 38 is eliminated as a result of disconnection between the lines 21 and 23 and the lines 20 and 22 by closing of the selector valve 37 (poppet valves 37*b* and 37*c*), and therefore, the extension of the arm cylinder 3 stops. At this time, although the switching valves 37 and 38 connected to the closed circuit pump 35 are disabled by the first valve fully closing switch 50, by using the switching valves 39 and 40 connected to the closed circuit pump 36, the boom cylinder 1 and the arm cylinder 3 can be driven, and therefore, operation of the machine body can be continued.

According to the present embodiment configured in such a manner as described above, in the case where one of the switching valves 37 to 40 is sticked in an open state by failure of the switching valves 37 to 40 or control systems therefor, by compulsorily closing the other switching valves connected to one closed circuit pump to which the selector valve that is sticked in an open state is connected, the two hydraulic actuators 1 and 3 are not connected to each other through any line. Consequently, operation of the hydraulic actuators 1 and 3, which is not intended by the operator, is suppressed, and operation of the machine body can be continued.

Embodiment 2

A second embodiment of the present invention is described principally in regard to differences from the first embodiment.

The present embodiment further includes an open circuit pump, a proportional valve and an assist valve, and the open circuit pump and the proportional valve are connected to the cylinder head of a single rod hydraulic cylinder through an assist line in which the assist valve is provided, such that hydraulic operating fluid of the closed circuit pump and hydraulic operating fluid of the open circuit pump are merged and supplied to the cylinder head to improve the extension speed of the cylinder while part of the hydraulic operating fluid discharged from the cylinder head is sucked by the closed circuit pump while part of the remaining part of the hydraulic operating fluid is discharged to the tank through the proportional valve to improve the contraction speed.

Figure 7A:
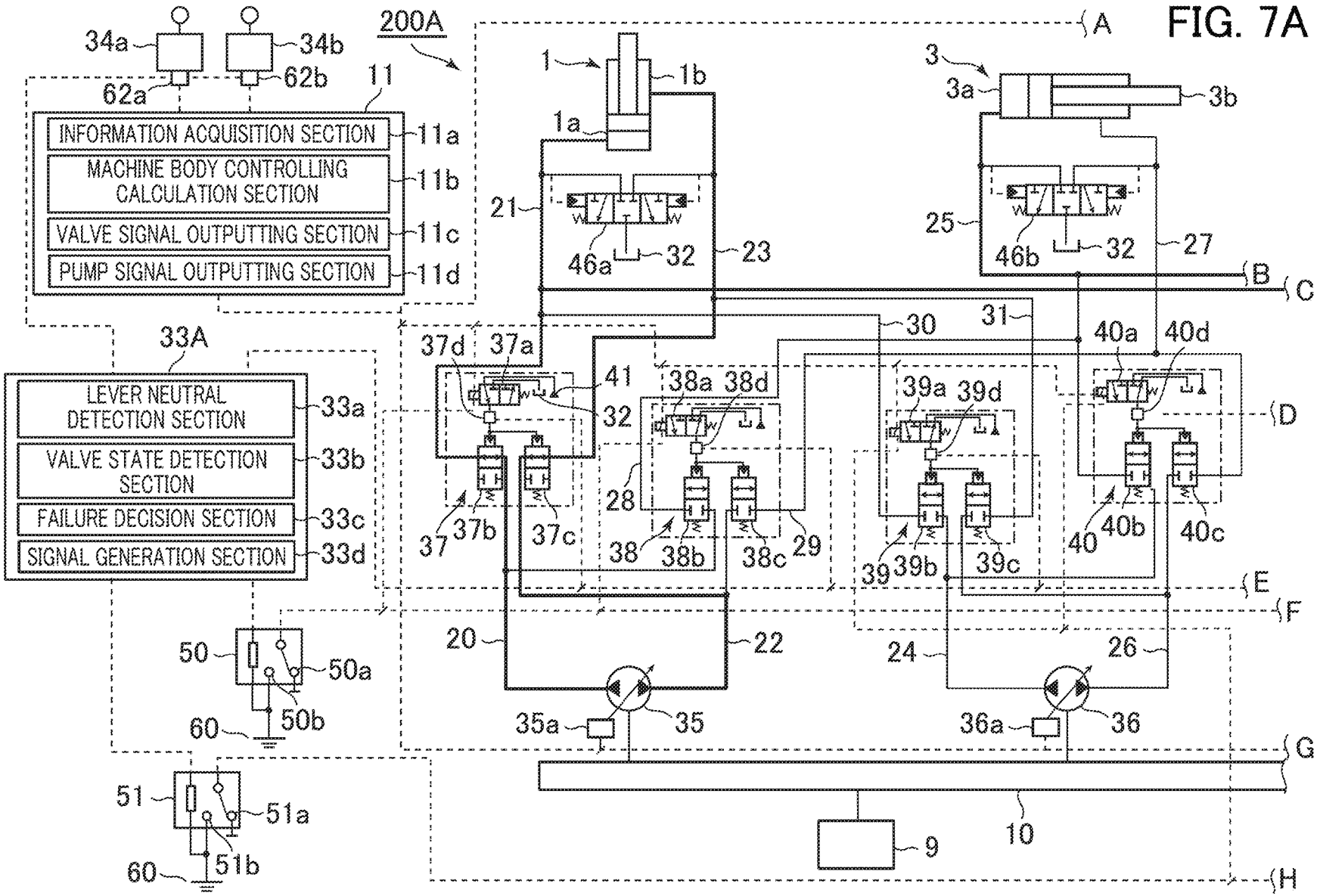
FIGS. 7A and 7B are schematic views depicting a configuration of a hydraulic system according to a second embodiment of the present invention.
Figure 7B:
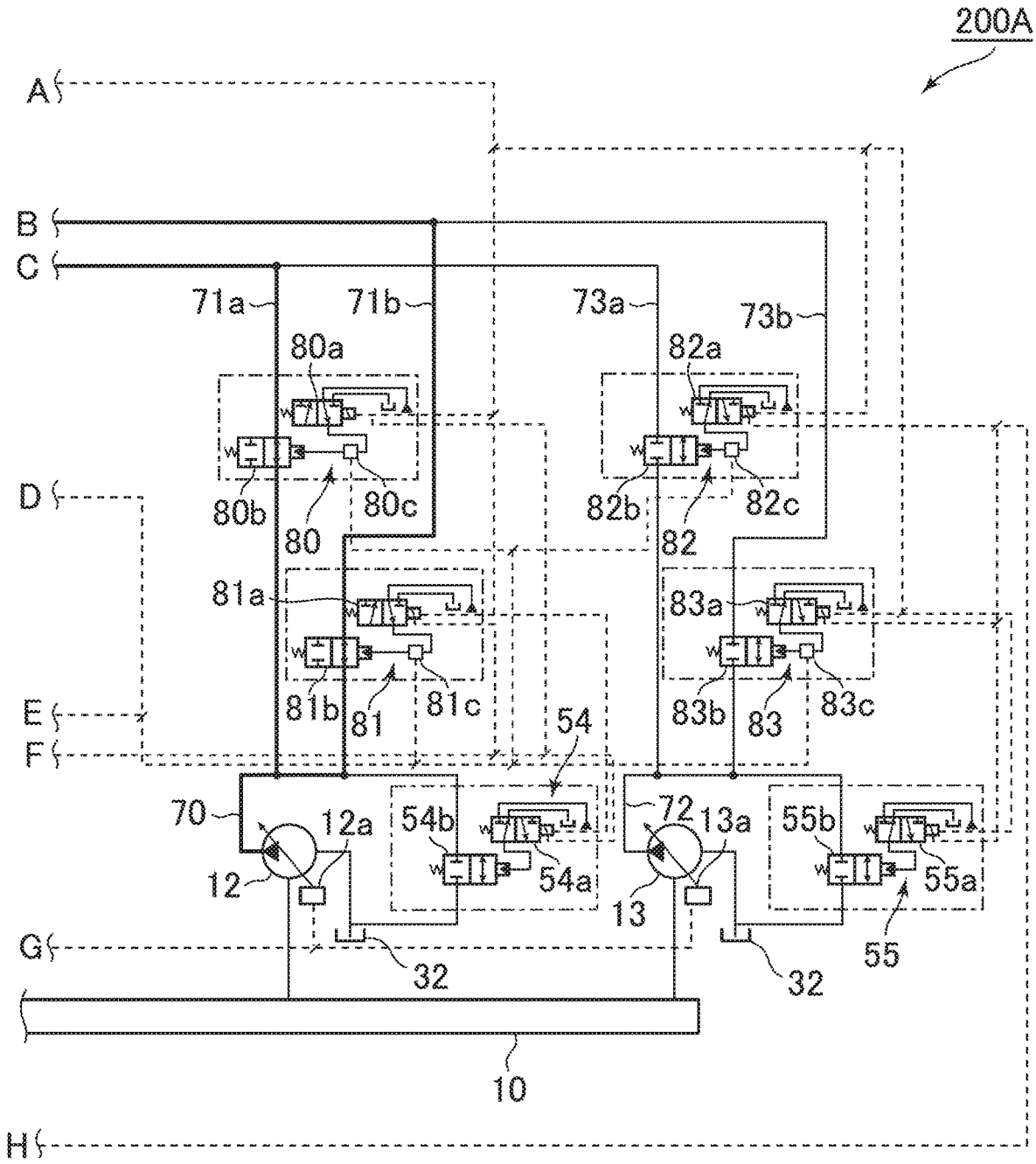

FIG. 7 is a schematic view depicting a configuration of a hydraulic system according to the present embodiment.

Referring to FIG. 7, the hydraulic system 200A further includes hydraulic pumps (hereinafter referred to as "open circuit pumps") 12 and 13 of the single tilting type, an assist line 70 connected to a delivery port of the open circuit pump 12, an assist line 71*a* that connects the assist line 70 to the line 21, an assist line 71*b* that connects the assist line 70 to the line 25, an assist line 72 connected to a delivery port of the open circuit pump 13, an assist line 73*a* that connects the assist line 72 to the line 21, an assist line 73*b* that connects the assist line 72 to the line 25, assist valves 80 to 83 provided in the assist lines 71*a*, 71*b*, 73*a* and 73*b*, and proportional valves 54 and 55 provided in lines that connect the assist lines 70 and 71 to the tank 32.

The open circuit pumps 12 and 13 are driven by power received from the engine 9 through the transmission device 10. The open circuit pumps 12 and 13 include tiling swash plate mechanisms (not depicted) each having an output port as flow rate adjustment means, and regulators 12*a* and 13*a* that adjust the tilt angle of the swash plates to adjust the pump displacement volume. The regulators 12*a* and 13*a* control the delivery flow rate of the open circuit pumps 12 and 13 on the basis of delivery flow rate command values received from the machine body controller 11. The open circuit pumps 12 and 13 suck hydraulic operating fluid from the tank 32 and deliver the hydraulic operating fluid to the assist lines 70 and 72, respectively.

The assist valve 80 includes a solenoid valve 80*a* and a poppet valve 80*b*. The solenoid valve 80*a* opens or closes in response to a control signal received from the machine body controller 11 to connect a pilot pressure receiving section of the poppet valve 80*b* to the pilot hydraulic fluid source 41 or the tank 32. In the case where a closing signal is inputted to the solenoid valve 80*a*, the pilot pressure receiving section of the poppet valve 80*b* is connected to the tank 32 and changes to a low pressure state, whereupon the poppet valve 80*b* is driven to the closing side by the spring force to disconnect the assist line 70 and the assist line 71 from each other. In the case where an opening signal is inputted to the solenoid valve 80*a*, the pilot chamber of the poppet valve 80*b* is connected to the pilot hydraulic fluid source 41 and the poppet valve 80*b* is driven to the open side by the pilot pressure to place the assist line 70 and the assist line 71 into a communication state with each other. It is to be noted that, although the present embodiment uses an assist valve that drives a poppet value using a pilot hydraulic pressure source and a solenoid valve as an example, only a solenoid valve that opens and closes an assist line by an electric signal may be used for the configuration. It is to be noted that, since the assist valves 81 to 83 are similar to the assist valve 80, description of them is omitted.

The proportional valves 54 and 55 open and close the poppet valves 54*b* and 55*b* by opening and closing of the solenoid valves 54*a* and 55*a* in response to control signals received from the machine body controller 11 similarly to the assist valves 80 to 83. However, since the valve opening of the solenoid valves 54*a* and 55*a* can be controlled continuously with respect to control command values from the machine body controller 11, also the proportional valves 54 and 55 are different from the assist valves 80 to 83 in that also the opening of the poppet valves 54*b* and 55*b* can be controlled continuously.

Now, the configuration relating to the present invention in the present embodiment is described.

In the assist valves 80 to 83, fifth to sixth pilot pressure sensors 80*c* to 83*c* are provided as a second sensor that detects open-closed states of the assist valves 80 to 83, respectively. The pilot pressure sensors 80*c* to 83*c* are connected to a valve device controller 33A through signal lines. For example, taking the assist valve 80 as an example, the pilot pressure sensor 80*c* is provided in a line that connects the solenoid valve 80*a* and the poppet valve 80*b* to each other. When a closing signal is inputted to the solenoid valve 80*a*, since the pilot pressure sensor 80*c* is connected to the tank 32, a low pressure is detected from the pilot pressure sensor 80*c*. On the other hand, when an opening signal is inputted to the solenoid valve 80*a*, since the pilot pressure sensor 80*c* is connected to the pilot hydraulic fluid source 41, a high pressure is detected from the pilot pressure sensor 80*c*. Also in the assist valves 80 to 83, the pilot pressure sensors 81*c* to 83*c* are provided individually in similar lines. It is to be noted that, although, in the present embodiment, the second sensor that detects open-closed states of the assist valves 80 to 83 is configured from the first to fourth pilot pressure sensors 37*d* to 40*d*, respectively, for example, where the assist valves are solenoid valves, the second sensor may be configured from stroke sensors for measuring the amount of movement of the valve body of the solenoid valves.

Figure 8:
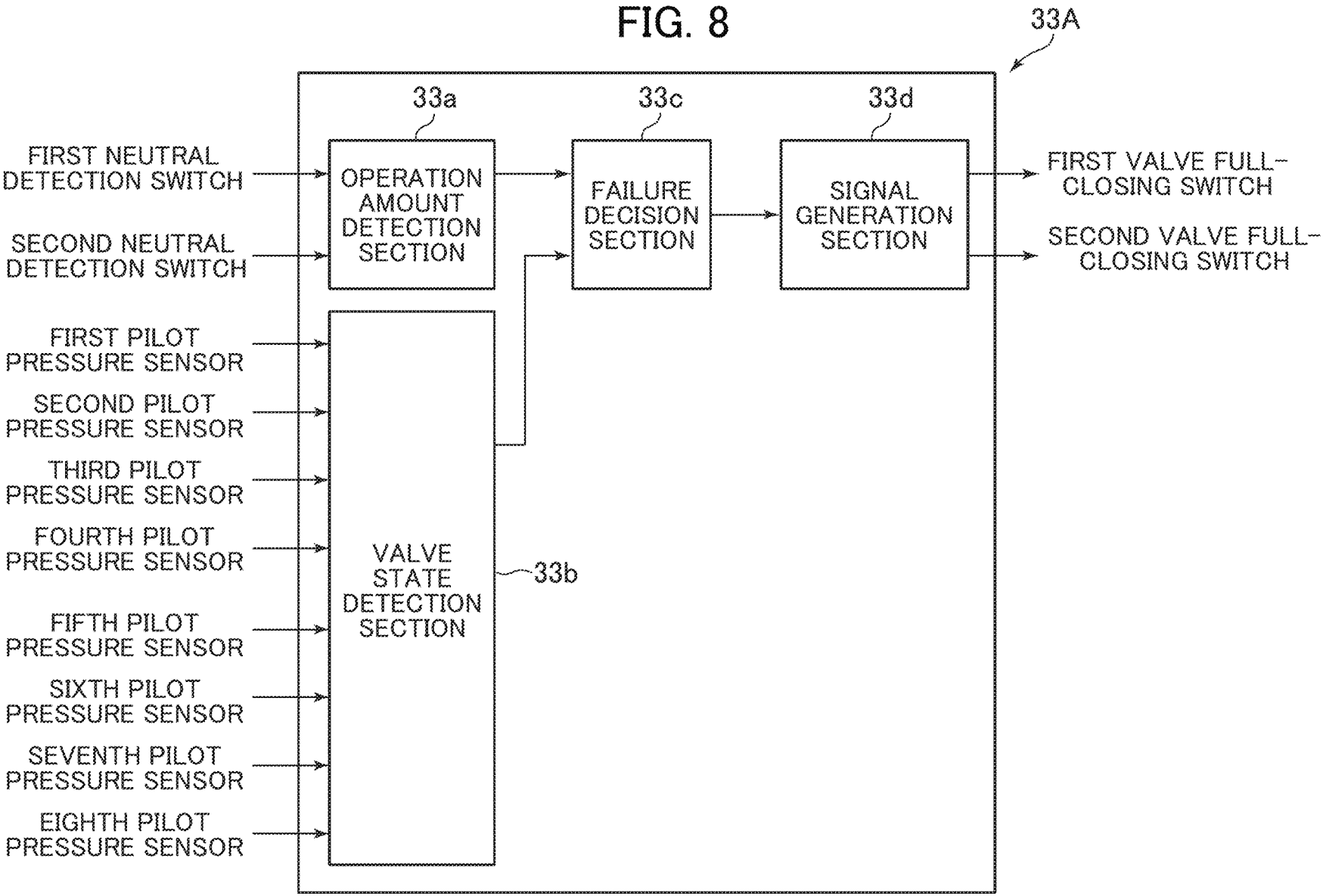
FIG. 8 is a block diagram depicting a configuration a valve device controller according to the second embodiment of the present invention.

FIG. 8 is a block diagram depicting a configuration of the valve device controller 33A according to the present embodiment.

Referring to FIG. 8, what is different from the first embodiment (depicted in FIG. 3) is that the valve state detection section 33*b* receives pressure signals from the pilot pressure sensors 80*c* to 83*c* in addition to pressure signals from the first to fourth pilot pressure sensors 37*d* to 40*d* and in a decision logic of the failure decision section 33*c*. The failure decision section 33*c* detects a failure of the switching valves 37 to 40 or the assist valves 80 to 83 on the basis of information from the operation amount detection section 33*a* and the valve state detection section 33*b*. Details of the decision method of the failure decision section 33*c* are hereinafter described. In the case where a failure of one of the switching valves 37 to 40 is detected from the failure decision section 33*c*, the signal generation section 33*d* outputs a closing signal to one of the first and second valve fully closing switches 50 and 51.

Figure 9:
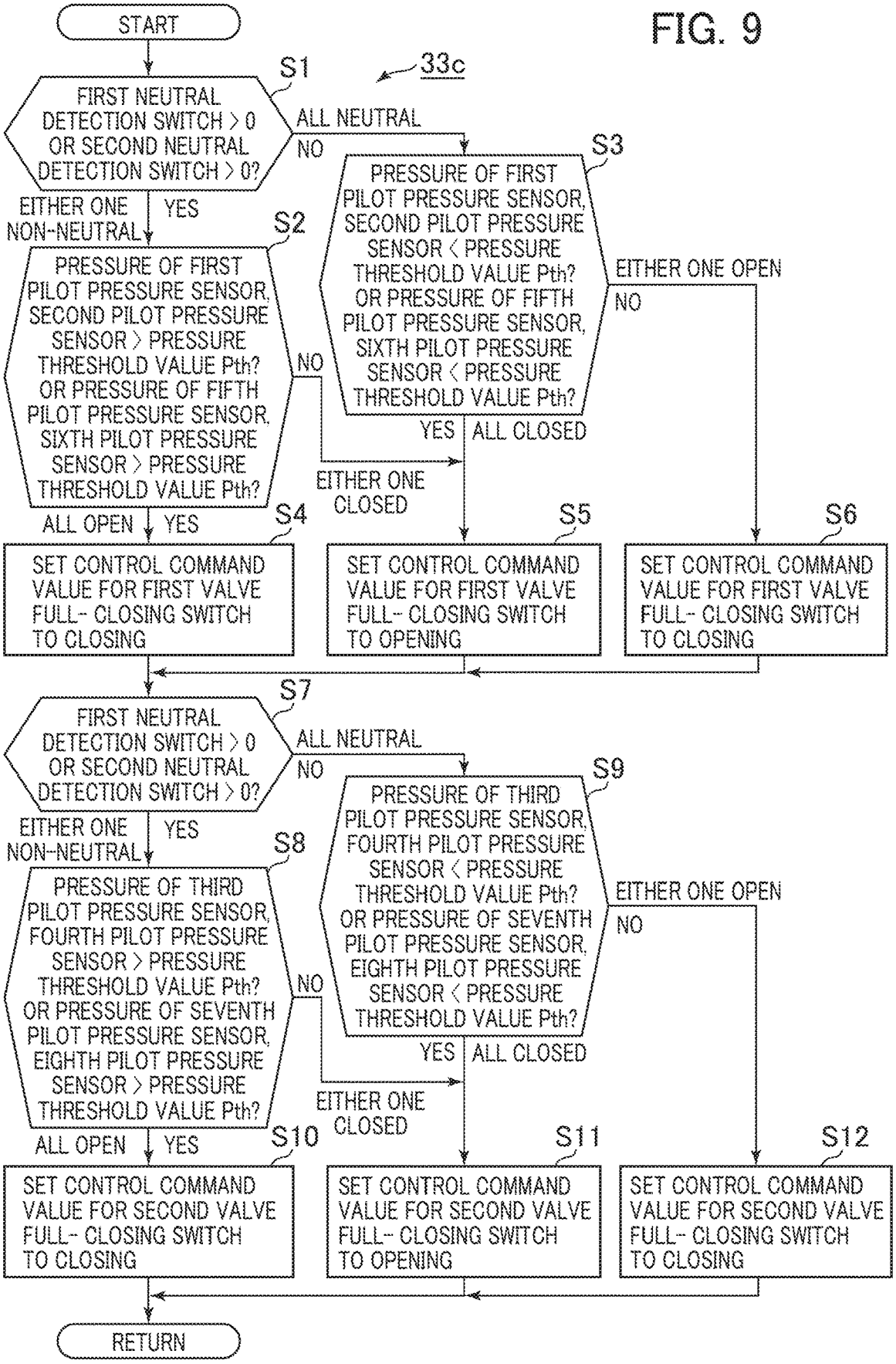
FIG. 9 is a flow chart illustrating processing by a failure decision section of the valve device controller according to the second embodiment of the present invention.

FIG. 9 is a flow chart depicting processing by the failure decision section 33*c* of the valve device controller 33A.

Referring to FIG. 9, the flow chart is different from that of the first embodiment (depicted in FIG. 5) at steps S2, S3, S8 and S9 of FIG. 9. At steps S2 and S3, in addition to open-close check of the switching valves 37 and 38 by the first and second pilot pressure sensors 37*d* and 38*d*, open-close check of the assist valves 80 and 81 by the fifth and sixth pilot pressure sensors 80*c* and 81*c* is performed. Further, at step S8 and S9, in addition to open-close check of the switching valves 39 and 40 by the third and fourth pilot pressure sensors 39*d* and 40*d*, open-close check of the assist valves 82 and 83 by the seventh and eighth pilot pressure sensors 82*c* and 83*c* is performed.

Referring to FIG. 7, the first valve fully closing switch 50 is connected to the valve device controller 33A and the solenoid valves 37*a*, 38*a*, 80*a*, 81*a* and 54*a* through control signal lines. Further, the second valve fully closing switch 51 is connected to the valve device controller 33A and the solenoid valves 39*a*, 40*a*, 82*a*, 83*a* and 55*a* through control signal lines. It is to be noted that, since the configuration of the first and second valve fully closing switches 50 and 51 is similar to that of the first embodiment, description of the same is omitted.

The first and second valve fully closing switches 50 and 51 are opened or closed in response to a control signal from the valve device controller 33A such that the control signal lines from the machine body controller 11 to the solenoid valves 37*a* to 40*a* and 80*a* to 83*a* are rendered conducting or non-conducting to open or close the solenoid valves 37*a* to 40*a* and 80*a* to 83*a*.

Now, operation of the hydraulic system 200A is described.

First, operation of the hydraulic system 200A in the case where the switching valves 37 to 40, assist valves 80 to 83 and machine body controller 11 operate normally is described.

Referring to FIG. 7, if an operator operates only the boom lever 34*a* within a range equal to or greater than one half the maximum operation amount to provide an input for driving the boom cylinder 1 to extend, then the information acquisition section 11*a* of the machine body controller 11 receives the operation amount of the boom lever 34*a*. The machine body controlling calculation section 11*b* sets the control command value for the switching valves 37 and 39 and the assist valves 80 and 82 to opening on the basis of the operation amount of the boom lever 34*a*, such that the closed circuit pumps 35 and 36 are connected to the boom cylinder 1 and besides sets the control command value for the switching valves 38 and 40 and the assist valves 81 and 83 to closing; sets the pump delivery flow rate command value for the closed circuit pumps 35 and 36 and the open circuit pumps 12 and 13 to values according to the operation amount of the boom lever 34*a*; and sets the control command value for the proportional valves 54 and 55 to closing.

The valve signal outputting section 11*c* outputs an opening signal to the switching valves 37 and 39 and the assist valves 80 and 82 on the basis of the control command values of the switching valves 37 to 40, assist valves 80 to 83 and proportional valves 54 and 55 from the machine body controlling calculation section 11*b*; outputs a closing signal to the switching valves 38 and 40 and the assist valves 81 and 84; and outputs a closing signal to the proportional valves 54 and 55. The pump signal outputting section 11*d* outputs control signals to the regulators 35*a* and 36*a* of the closed circuit pumps 35 and 36 and the regulators 12*a* and 13*a* of the open circuit pumps 12 and 13 on the basis of pump delivery flow rate command values from the machine body controlling calculation section 11*b*.

The closed circuit pumps 35 and 36 deliver hydraulic operating fluid to the lines 20 and 24 with delivery flow rates controlled by the regulators 35*a* and 36*a*, respectively. Meanwhile, the open circuit pumps 12 and 13 deliver hydraulic operating fluid to the assist lines 70 and 72 with delivery flow rates controlled by the regulators 12*a* and 13*a*, respectively.

In response to the control signals from the machine body controller 11, the switching valves 37 and 39 and the assist valves 80 and 82 are opened while the switching valves 38 and 40 and the assist valves 81 and 83 are closed and the proportional valves 54 and 55 are closed.

The hydraulic operating fluid delivered from the closed circuit pump 35 flows to the line 21 through the line 20 and the selector valve 37. The hydraulic operating fluid delivered from the closed circuit pump 36 flows to the line 21 through the line 24, selector valve 39 and line 30. Further, the hydraulic operating fluid delivered from the open circuit pump 12 flows to the line 21 through the assist valve 80 (poppet valve 80*b*) and the assist line 71*a*. The hydraulic operating fluid delivered from the open circuit pump 13 flows to the line 21 through the assist line 72, the assist valve 82 (poppet valve 82*b*) and the assist line 71. The hydraulic operating fluid from the closed circuit pumps 35 and 36 and the hydraulic operating fluid from the open circuit pumps 12 and 13 merge at the line 21 and flow into the cylinder head 1*a* of the boom cylinder 1 to extend the boom cylinder 1. Part of the hydraulic operating fluid discharged from the cylinder rod 1*b* of the boom cylinder 1 is sucked into the closed circuit pump 35 through the line 23, poppet valve 37*b* of the selector valve 37 and line 22. The part of the remaining part of the hydraulic operating fluid discharged from the cylinder rod 1*b* of the boom cylinder 1 is sucked into the closed circuit pump 36 through the line 31, selector valve 39 (poppet valve 39*b*) and line 24.

Referring to FIG. 7, since only the boom lever 34*a* is operated, the first neutral detection switch 62*a* outputs 1 and the second neutral detection switch 62*b* outputs 0.

Referring to FIG. 8, the operation amount detection section 33*a* of the valve device controller 33A detects signals of the first and second neutral detection switches 62*a* and 62*b*. Meanwhile, the valve state detection section 33*b* detects a high pressure of the first, third, fifth and seventh pilot pressure sensors 37*d*, 39*d*, 80*c* and 82*c* from opening of the solenoid valves 37*a*, 39*a*, 80*a* and 82*a* and detects a low pressure of the second, fourth, sixth and eighth pilot pressure sensors 38*d*, 40*d*, 81*c* and 83*c* from closing of the solenoid valves 38*a*, 40*a*, 81*a* and 83*a*.

Referring to FIG. 9, the failure decision section 33*c* executes steps S1, S2, S5, S7, S8 and S11 in this order and sets the control command value for the first and second valve fully closing switches 50 and 51 to opening.

Referring to FIG. 8, the signal generation section 33*d* of the valve device controller 33A outputs an opening signal to the first and second valve fully closing switches 50 and 51 on the basis of control command values for the first and second valve fully closing switches 50 and 51 of the failure decision section 33*c*.

Referring to FIG. 7, the first valve fully closing switch 50 receives an opening signal from the valve device controller 33A and connects the control signal lines from the solenoid valves 37*a*, 38*a*, 80*a* and 81*a* to the ground side contact 50*b*. Meanwhile, the second valve fully closing switch 51 receives an opening signal from the valve device controller 33A and connects the control signal lines from the solenoid valves 39*a*, 40*a*, 82*a* and 83*a* to the ground side contact 51*b*. The conduction state of the control signal lines is maintained. Consequently, the conducting state of the control signals is maintained, and the control signals for the switching valves 37 and 39 and the assist valves 80 and 82 from the machine body controller 11 are enabled, and the open state of the switching valves 37 and 39 and the assist valves 80 and 82 and the closed state of the switching valves 38 and 40 and the assist valves 81 and 83 are maintained.

Now, operation of the hydraulic system 200A in the case where the assist valve 81 is sticked in an open state is described principally with reference to FIG. 7. It is to be noted that, in FIG. 7, a flow of hydraulic operating fluid in the case where the assist valve 81 is sticked in an open state is indicated by a thick line.

Referring to FIG. 7, if an operator operates only the boom lever 34*a* within a range equal to or smaller than one half the maximum operation amount to provide an input for driving the boom cylinder 1 to extend, then the information acquisition section 11*a* of the machine body controller 11 detects the operation amount of the boom lever 34*a*. The machine body controlling calculation section 11*b* sets the control command value for the selector valve 37 and the assist valve 80 to opening and besides sets the control command value for the switching valves 38 to 40 and the assist valves 81 to 83 to closing on the basis of the operation amount of the boom lever 34*a*, and sets the delivery flow rate command value for the closed circuit pump 35 and the open circuit pump 12 to values according to the operation amount of the boom lever 34*a* and the sets the control command value for the proportional valve 54 to closing, such that the closed circuit pump 35 and the open circuit pump 12 are connected to the boom cylinder 1.

The valve signal outputting section 11*c* outputs an opening signal to the selector valve 37 and the assist valve 80 and outputs a closing signal to the switching valves 38 to 40 and the assist valves 81 to 83 on the basis of the control command values for the switching valves 37 to 40 from the machine body controlling calculation section 11*b*, and outputs a closing signal to the switching valves 38 to 40 and the assist valves 81 and 84. Meanwhile, the machine body controlling calculation section 11*b* outputs a closing signal to the proportional valve 54. The pump signal outputting section 11*d* outputs control signals to the regulator 35*a* of the closed circuit pump 35 and the regulator 12*a* of the open circuit pump 12 on the basis of a pump delivery flow rate command value from the machine body controlling calculation section 11*b*.

The closed circuit pump 35 and the open circuit pump 12 deliver hydraulic operating fluid to the line 20 and the assist line 70 with delivery flow rates controlled by the regulators 35*a* and 12*a*, respectively. The selector valve 37 and the assist valve 80 are opened in response to an opening signal, and the switching valves 38 to 40 and the assist valves 81 to 83 are closed in response to a closing signal. It is assumed that, at this time, the assist valve 81 fails and is sticked in an open state. In other words, it is assumed that, although a closing signal is inputted from the machine body controlling calculation section 11*b*, the solenoid valve 81*a* is not closed and the poppet valve 81*b* remains open. Here, since the assist valve 80 is open in accordance with the opening signal from the machine body controller 11, by the sticking in an open state of the assist valve 81, the assist valves 80 and 81 (poppet valves 80*b* and 81*b*) are opened simultaneously, and the cylinder head 1*a* of the boom cylinder 1 is connected to the cylinder head 3*a* of the arm cylinder 3 through the line 21, the assist lines 71*a*, 70 and 71*b* and the line 25. If, in this state, a load acts in the contraction direction upon the boom cylinder 1, then the hydraulic operating fluid of the cylinder head 1*a* of the boom cylinder 1 flows out due to the load and flows into the cylinder head 3*a* of the arm cylinder 3 through the line 21, assist lines 71*a*, 70 and 71*b* and line 25. As a result, although the arm lever 34*b* is not operated, the arm cylinder 3 is extended.

Since, in FIG. 7, only the boom lever 34*a* is operated, the first neutral detection switch 62*a* outputs 1 and the second neutral detection switch 62*b* outputs 0.

Referring to FIG. 8, the operation amount detection section 33*a* of the valve device controller 33A detects signals of the first and second neutral detection switches 62*a* and 62*b*. Meanwhile, the valve state detection section 33*b* detects a high pressure of the first and fifth pilot pressure sensors 37*d* and 80*c* from opening of the solenoid valves 37*a* and 80*a* and detects a low pressure of the second to fourth, seventh and eighth pilot pressure sensors 38*d* to 40*d*, 82*c* and 83*c* from closing of the solenoid valves 38*a* to 40*a*, 82*a* and 83*a*. Further, the valve state detection section 33*b* outputs a high pressure of the sixth pilot pressure sensor 81*c* because the solenoid valve 81*a* is sticked in an open state.

Referring to FIG. 9, the failure decision section 33*c* executes steps S1 and S2 in this order. Here, since both of the pressures of the fifth and sixth pilot pressure sensors 80*c* and 81*c* are high, the failure decision section 33*c* decides at step S42 that both of the pressures of the fifth and sixth pilot pressure sensors 80*c* and 81*c* are higher than the pressure threshold value Pth (Yes), and sets, at step S4, the control command value for the first valve fully closing switch 50 to closing. Thereafter, steps S7, S8 and S11 are executed in this order, and the control command value for the second valve fully closing switch 51 is set to opening.

Referring to FIG. 8, the signal generation section 33*d* of the valve device controller 33A outputs a closing signal to the first valve fully closing switch 50 and outputs an opening signal to the second valve fully closing switch 51 on the basis of the control command values of the failure decision section 33*c* for the first and second valve fully closing switches 50 and 51.

Referring to FIG. 7, the first valve fully closing switch 50 receives the closing signal from the valve device controller 33A and connects the signal lines from the solenoid valves 37*a*, 38*a*, 80*a* and 81*a* to the open side contact 50*a*. Consequently, since transmission of the control signal from the machine body controller 11 to the assist valve 80 is disabled, the solenoid valve 80*a* is not driven to the open side and is closed by the spring force to close the assist valve 80 (poppet valve 80*b*). As a result, since the state in which the cylinder head 1*a* of the boom cylinder 1 and the cylinder head 3*a* of the arm cylinder 3 are connected to each other through the line 21, assist lines 71*a*, 70 and 71*b* and line 25 as a result of the sticking in an open state of the assist valve 81 is cancelled by the disconnection of the assist line 71*a* and the assist line 70 as a result of the closing of the assist valve 80 (poppet valve 80*b*), the extension of the arm cylinder 3 stops. At this time, although the switching valves 37 and 38 connected to the closed circuit pump 35 and the assist valves 80 and 81 connected to the open circuit pump 12 are disabled by the first valve fully closing switch 50, since the boom cylinder 1 and the arm cylinder 3 can be driven by use of the switching valves 39 and 40 connected to the closed circuit pump 36 and the assist valves 82 and 83 connected to the open circuit pump 13, operation of the machine body can be continued.

According to the present embodiment configured in such a manner as described above, the following advantageous effects are achieved in addition to advantageous effects similar to those of the first embodiment.

In the case where one assist valve among the assist valves 80 to 83 is sticked in an open state by a failure of any of the assist valves 80 to 83 or a control system therefor, by compulsorily closing the other assist valves connected to one open circuit pump to which the assist valve sticking in an open state is connected, connection of the two hydraulic actuators 1 and 3 to each other is avoided, and consequently, operation of the hydraulic actuators 1 and 3, which is not intended by the operator, can be suppressed and operation of the machine body can be continued.

It is to be noted that the first and second valve fully closing switches 50 and 51 in the present embodiment configure a first compulsory valve closing device that switches the switching valves 37 to 40 to their closed position irrespective of the open-close control by the machine body controller 11 and a second compulsory valve closing device that switches the assist valves 80 to 83 to their closed position irrespective of the open-close control by the machine body controller 11. Further, the valve fully closing switches as the second compulsory valve closing device may be provided separately from the first and second valve fully closing switches 50 and 51.

Embodiment 3

A third embodiment of the present invention is described principally in regard to differences from the first embodiment.

In the present embodiment, the arm cylinder 3 (depicted in FIG. 2) in the first embodiment is replaced with the swing motor 7 (depicted in FIG. 1). Referring to FIG. 1, since the swing motor 7 is a hydraulic actuator for swinging the upper swing structure 102, for example, when excavating or the like is performed, the swing motor 7 plays a significant role in adjustment of the excavation position of the front work implement 104 that is an operating device and adjustment of the collapse position after excavation. However, in the case where one of the switching valves 37 to 40 is sticked in an open state or in the case where the machine body controller 11 fails, unintended operation of the swing motor occurs and positioning of the front work implement 104 becomes difficult. The present embodiment suppresses, in the case where one of the switching valves 37 to 40 is sticked in an open state, unintended operation of the swing motor 7 such that operation of the machine body can be continued.

Figure 10:
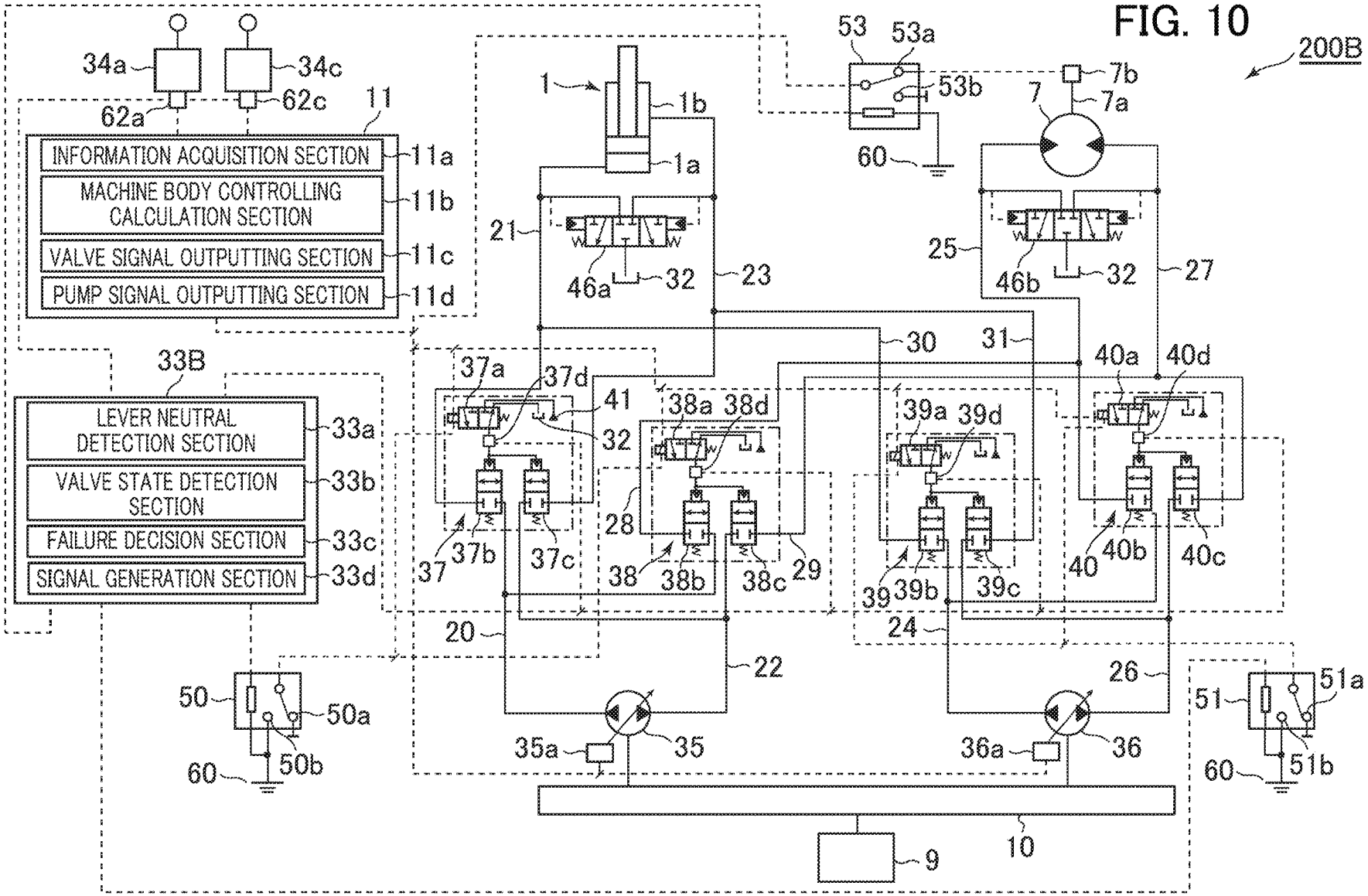
FIG. 10 is a schematic view depicting a configuration of a hydraulic system according to a third embodiment of the present invention.

FIG. 10 is a schematic view depicting a configuration of the hydraulic system according to the present embodiment.

Referring to FIG. 10, to the lines 25 and 27, the swing motor 7 is connected in place of the arm cylinder 3 (depicted in FIG. 2). Further, the hydraulic system 200B includes a swing lever 34*c* and a third neutral detection switch 62*c* for detecting the swing lever 34*c* and the neutral of the swing lever 34*c* in place of the arm lever 34*b* and the second neutral detection switch 62*b* (depicted in FIG. 2). Further, the swing motor 7 is connected to the upper swing structure 102 of FIG. 1 through a swing shaft 7*a*. To the swing shaft 7*a*, a swing brake 7*b* such as, for example, a friction brake is connected. The swing brake 7*b* serves as both of a deceleration brake for decelerating (braking) swinging and a parking brake for suppressing swinging. The swing brake 7*b* is configured such that it operates, for example, when a control signal is not inputted thereto from the machine body controller 11 and cancels the braking when a control signal is inputted thereto from the machine body controller 11.

A swinging stopping switch 53 is provided on a control signal line that connects the machine body controller 11 and the swing brake 7*b* to each other. The swinging stopping switch 53 is connected to a valve device controller 33B through a control signal line and switchably has a connection side contact 53*a* and an open side contact 53*b*. The swinging stopping switch 53 is switched to the connection side contact 53*a* or the open side contact 53*b* in accordance with a control signal from the valve device controller 33B to conduct or interrupt a control signal from the machine body controller 11 to the swing brake 7*b*. Consequently, the swinging stopping switch 53 configures a compulsory operation device for operating the swing brake 7*b* irrespective of control by the machine body controller 11. In the present embodiment, it is assumed that, as an example, in the case where a control signal from the valve device controller 33B is not inputted to the swinging stopping switch 53, the swinging stopping switch 53 is connected to the connection side contact 53*a* as an initial state thereof. Further, in the present embodiment, although the swinging stopping switch 53 is configured from an electric relay, this is not restrictive.

Now, operation of the hydraulic system 200B in the case where the selector valve 38 is sticked in an open state is described.

Referring to FIG. 10, if an operator operates only the boom lever 34*a* within a range equal to or smaller than one half the maximum operation amount to provide an input for driving the boom cylinder 1 to extend, then the information acquisition section 11*a* of the machine body controller 11 detects the operation amount of the boom lever 34*a*. The machine body controlling calculation section 11*b* sets the control command value for the selector valve 37 to opening and sets the control command value for the switching valves 38 to 40 to closing on the basis of the operation amount of the boom lever 34*a* such that only the closed circuit pump 35 is connected to the boom cylinder 1, and sets the pump delivery flow rate command value for the closed circuit pump 35 to a value according to the operation amount of the boom lever 34*a* and sets the control command value for the swing brake 7*b* to cancelling.

The valve signal outputting section 11*c* outputs an opening signal to the selector valve 37 and outputs a closing signal to the switching valves 38 to 40 on the basis of the control command values for the switching valves 37 to 40 from the machine body controlling calculation section 11*b*. Further, the valve signal outputting section 11*c* outputs a closing signal to the swinging stopping switch 53 such that the swing brake 7*b* is cancelled. The pump signal outputting section 11*d* outputs a control signal to the regulator 35*a* of the closed circuit pump 35 on the basis of the pump delivery flow rate command value from the machine body controlling calculation section 11*b*.

The swinging stopping switch 53 is connected, in its initial state, to the connection side contact 53*a*, and since the control signal line that connects the machine body controller 11 and the swing brake 7*b* to each other is in a conducting state, the swing brake 7*b* is cancelled by the cancelling signal from the machine body controller 11 and the swing shaft 7*a* is in a rotatable condition.

The closed circuit pump 35 delivers hydraulic operating fluid to the line 20 with the delivery flow rate controlled by the regulator 35*a*. It is assumed that the selector valve 38 fails and is sticked in an open state at this time. Here, since the selector valve 37 is open in accordance with the opening signal from the machine body controller 11, by the sticking in an open state of the solenoid valve 38*a*, the switching valves 37 and 38 (poppet valves 37*b*, 37*c*, 38*b* and 38*c*) are opened simultaneously, and the boom cylinder 1 and the swing motor 7 are connected to each other through the lines 21, 20, 28 and 25 and the lines 23, 22, 29 and 27. If it is assumed that, in this state, for example, a load in the contraction direction acts upon the boom cylinder 1, then the hydraulic operating fluid of the cylinder head 1*a* of the boom cylinder 1 flows out due to the load and flows into the swing motor 7 through the lines 21, 20, 28 and 25. As a result, although the swing lever 34*c* is not operated, the swing motor 7 rotates and the upper swing structure 102 (depicted in FIG. 1) swings.

Referring to FIG. 10, since only the boom lever 34*a* is operated, the first neutral detection switch 62*a* outputs 1 and the second neutral detection switch 62*b* outputs 0.

Figure 11:
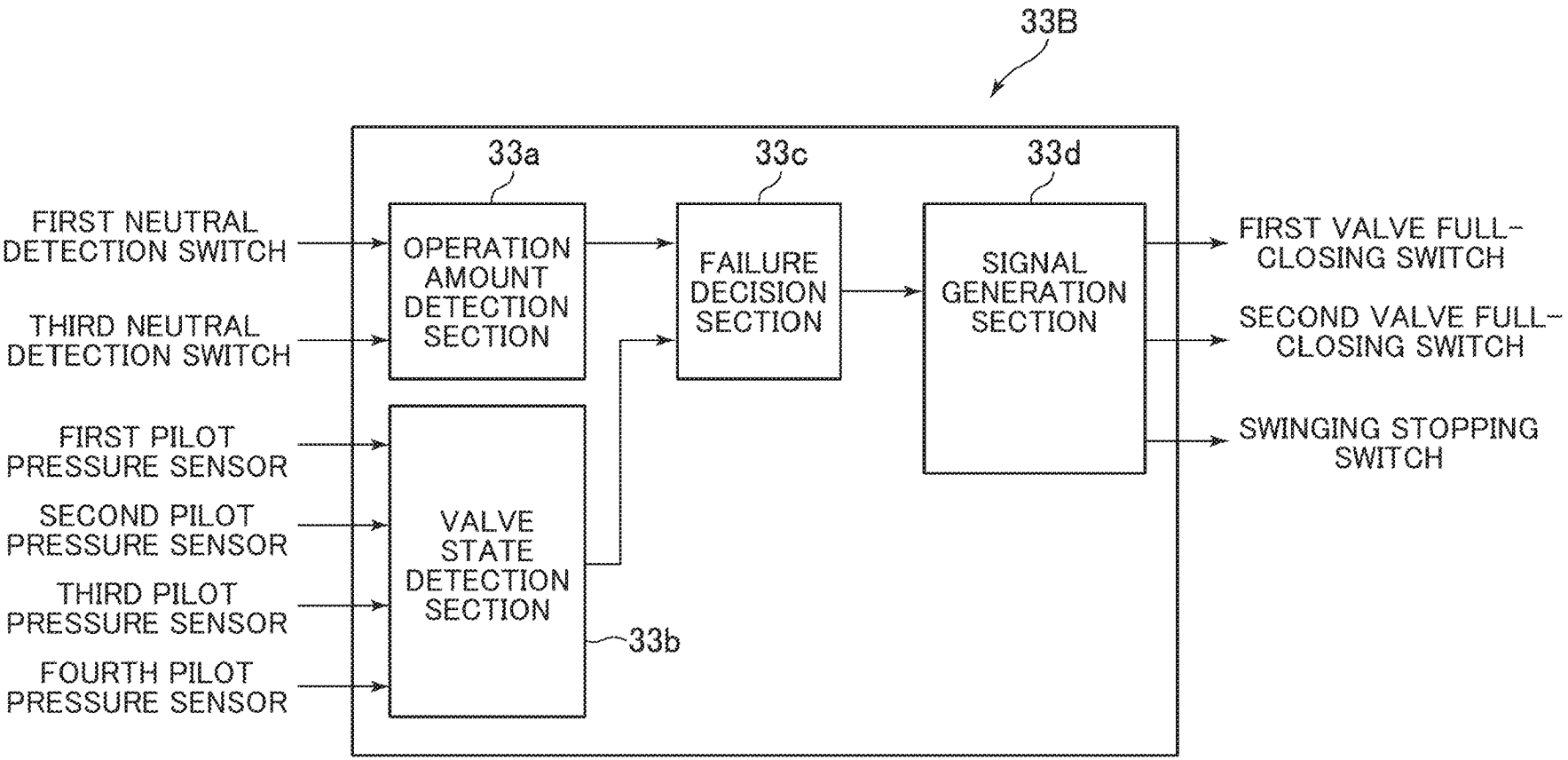
FIG. 11 is a block diagram depicting a configuration of a valve device controller according to the third embodiment of the present invention.

Referring to FIG. 11, the operation amount detection section 33*a* of the valve device controller 33B detects signals of the first and third neutral detection switches 62*a* and 62*c*. The valve state detection section 33*b* detects a high pressure of the first pilot pressure sensor 37*d* from opening of the solenoid valve 37*a* and detects a low pressure of the third and fourth pilot pressure sensors 39*d* and 40*d* from closing of the solenoid valves 39*a* and 40*a*. Further, since the solenoid valve 38*a* is sticked in an open state, the valve state detection section 33*b* detects a high pressure of the second pilot pressure sensor 38*d*.

Referring to FIG. 5, the failure decision section 33*c* executes steps S1 and S2 in this order. Here, since both of the pressures of the pilot pressure sensors 37*d* and 38*d* are a high pressure, it is decided at step S2 that both of the pressures of the first and second pilot pressure sensors 37*d* and 38*d* are higher than the pressure threshold value Pth (Yes), and the control command value for the first valve fully closing switch 50 is set to closing at step S4. Thereafter, steps S7, S8 and S11 are executed in this order and the control command value for the second valve fully closing switch 51 is set to opening.

Referring to FIG. 11, the signal generation section 33*d* of the valve device controller 33B outputs a closing signal to the first valve fully closing switch 50 and outputs an opening signal to the second valve fully closing switch 51 on the basis of the control command values for the first and second valve fully closing switches 50 and 51 set by the failure decision section 33*c*. Further, the signal generation section 33*d* outputs a cancellation signal for the swing brake 7*b* to the swinging stopping switch 53.

Referring to FIG. 10, the first valve fully closing switch 50 receives the closing signal from the valve device controller 33B and connects the control signal lines from the solenoid valves 37*a* and 38*a* to the open side contact 50*a*. Consequently, since the transmission of a control signal from the machine body controller 11 to the selector valve 37 is disabled, the solenoid valve 37*a* is not driven to the opening side and is closed by spring force to close the selector valve 37 (poppet valves 37*b* and 37*c*). As a result, since the state in which the boom cylinder 1 and the swing motor 7 are connected to each other through the lines 21, 20, 28 and 25 and the lines 23, 22, 29 and 27 as a result of the sticking in an open state of the selector valve 38 is cancelled by the disconnection of the lines 21 and 23 and the lines 20 and 22 by the closing of the selector valve 37 (poppet valves 37*b* and 37*c*), the driving of the swing motor 7 stops. Further, since transmission of the cancelling signal from the machine body controller 11 to the swing brake 7*b* is disabled as a result of the connection of the control signal line from the machine body controller 11 to the open side contact 53*b* by the control signal from the valve device controller 33B, the brake acts upon the swing shaft 7*a* by the swing brake 7*b* to stop rotation of the swing motor 7.

Also in the present embodiment configured in such a manner as described above, advantageous effects similar to those of the first embodiment are achieved. Further, in the case where one of the switching valves 37 to 40 is sticked in an open state by a failure of one of the switching valves 37 to 40 or a control system therefor, it is possible to operate the swing brake 7*b* to stop the swing motor 7 with certainty.

Embodiment 4

A fourth embodiment of the present invention is described principally in regard to differences thereof from the first embodiment.

According to the present embodiment, a first sensor is configured from a pump pressure sensor for detecting a pump pressure of a closed circuit pump and a load pressure sensor for detecting a load pressure of a hydraulic actuator in place of the first to fourth pilot pressure sensors 37*d* to 40*d* (depicted in FIG. 2) in the first embodiment.

Figure 12:
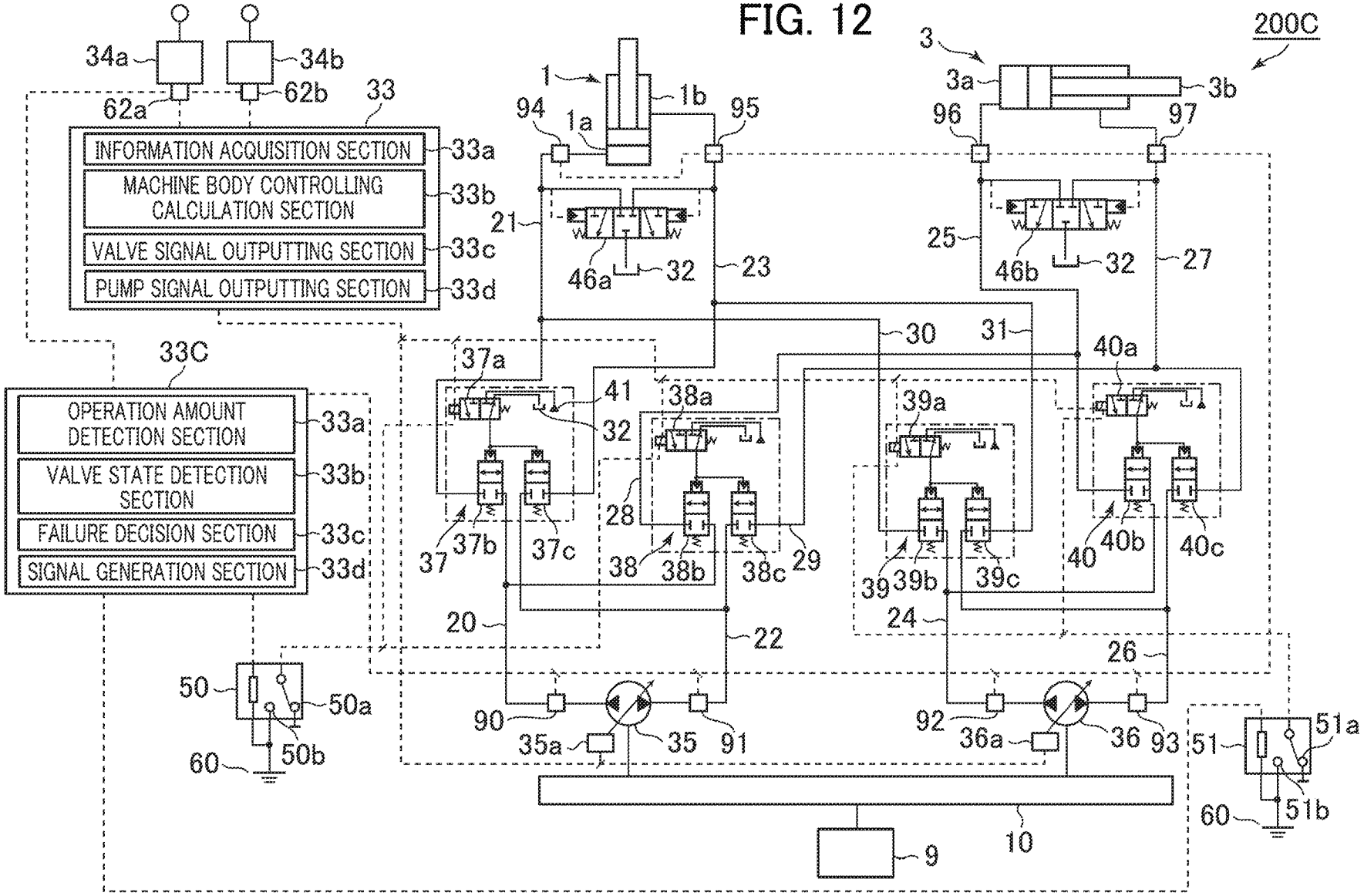
FIG. 12 is a schematic view depicting a configuration of a hydraulic system according to a fourth embodiment of the present invention.

FIG. 12 is a schematic view depicting a configuration of a hydraulic system according to the present embodiment.

Referring to FIG. 12, the hydraulic system 200C includes first to fourth pump pressure sensors 90 to 93 for detecting the pump pressure of the closed circuit pumps 35 and 36 and first to fourth cylinder pressure sensors (load pressure sensors) 94 to 97 for detecting the load pressure of the boom cylinder 1 and the arm cylinder 3 in place of the first to fourth pilot pressure sensors 37*d* to 40*d* (depicted in FIG. 2). The first to fourth pump pressure sensors 90 to 93 and the first to fourth cylinder pressure sensors 94 to 97 are connected to a valve device controller 33C through signal lines.

Figure 13:
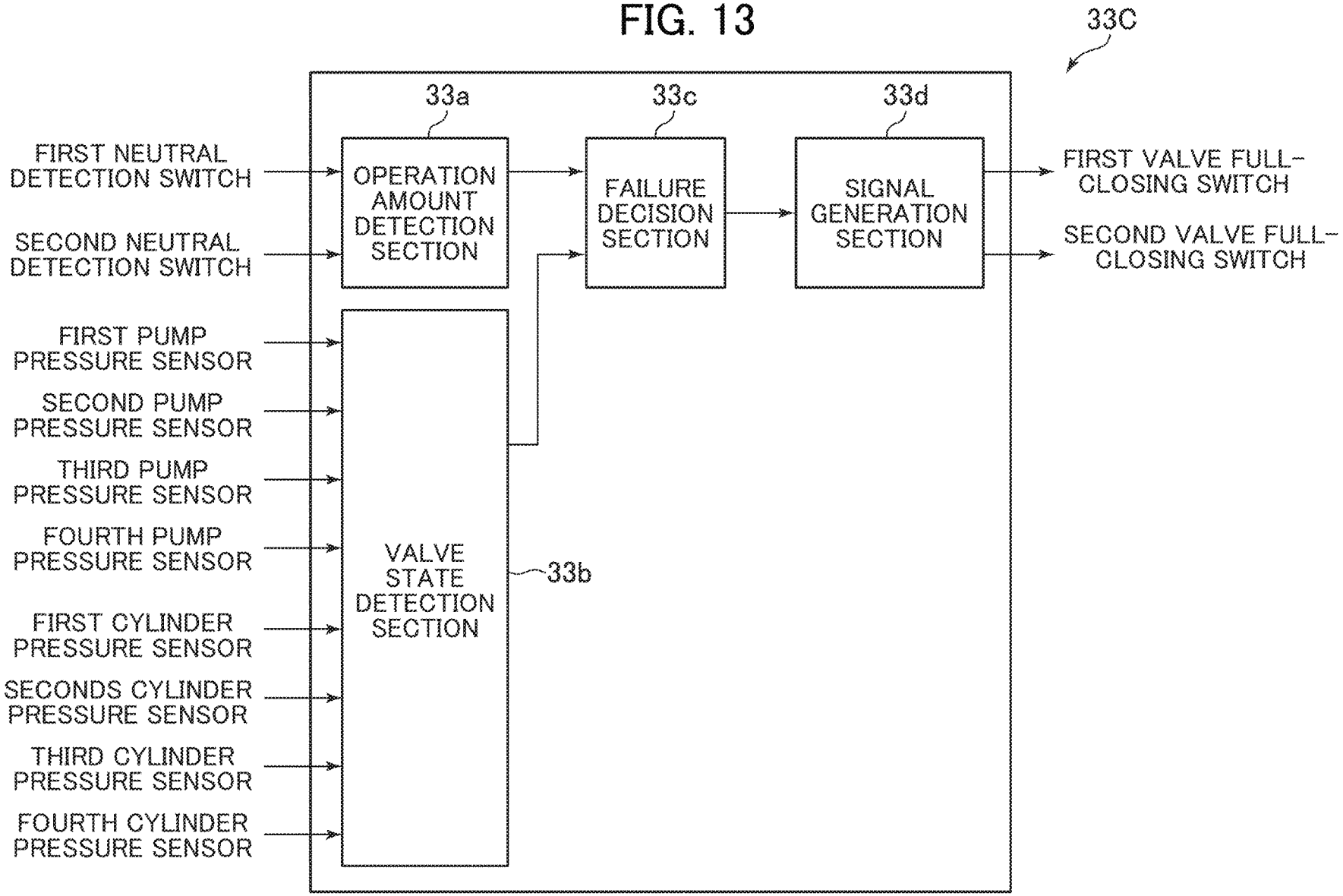
FIG. 13 is a block diagram depicting a configuration of a valve device controller according to the fourth embodiment of the present invention.

FIG. 13 is a block diagram depicting a configuration of the valve device controller 33C according to the present embodiment.

Referring to FIG. 13, the valve state detection section 33*b* of the valve device controller 33C detects the pressure (pump pressure) of the lines 20, 22, 24 and 26 through the first to fourth pump pressure sensors 90 to 93 and detects the pressure (load pressure) of the lines 21, 23, 25 and 27 through the first to fourth cylinder pressure sensors 94 to 97.

Figure 14:
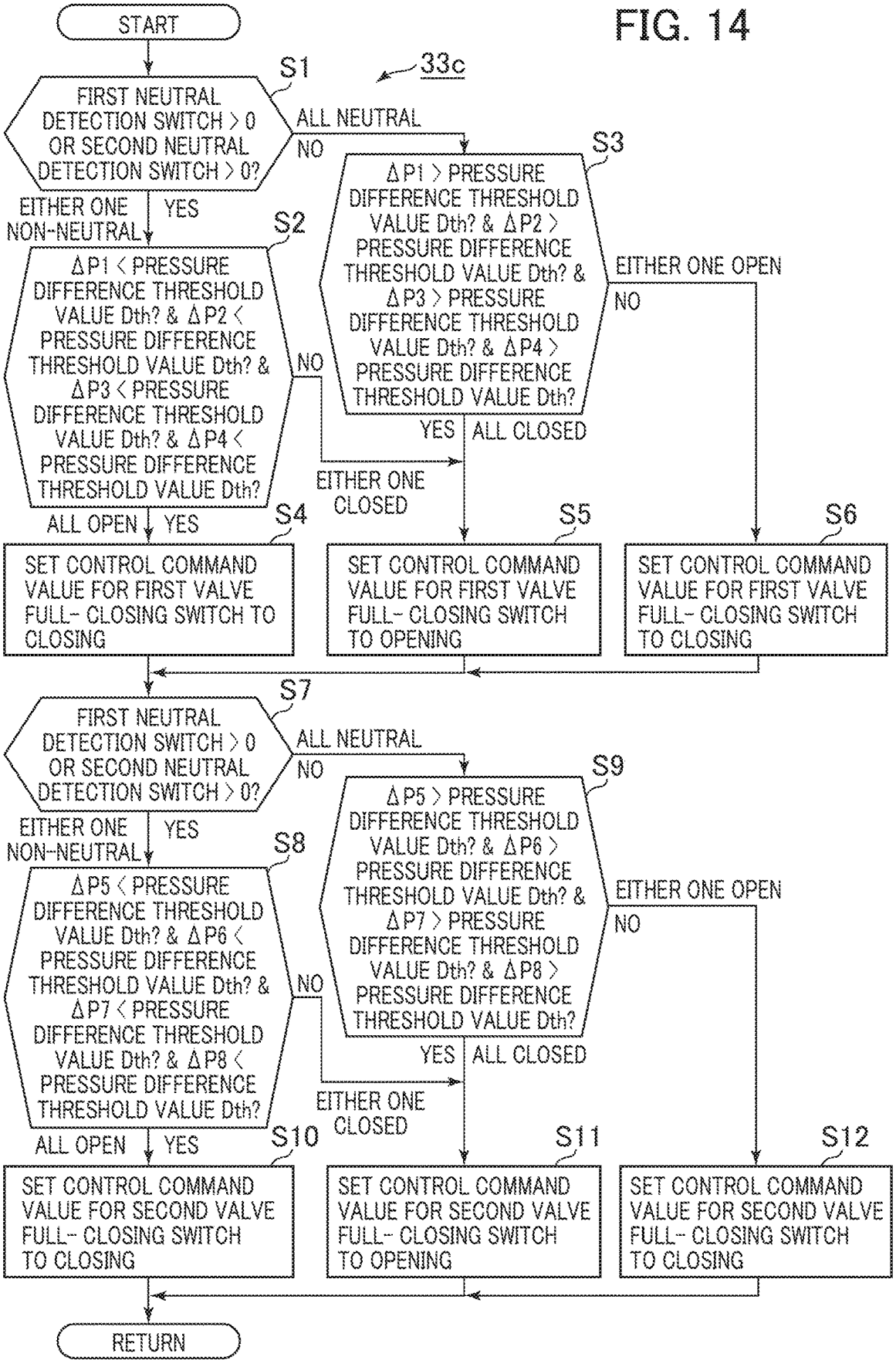
FIG. 14 is a flow chart illustrating processing by a failure decision section of the valve device controller according to the fourth embodiment of the present invention.

FIG. 14 is a flow chart depicting processing by the failure decision section 33*c* of the valve device controller 33C.

Referring to FIG. 14, the difference from that of the first embodiment (depicted in FIG. 5) is at steps S2, S3, S8 and S9. The pressure differences ΔP1 to ΔP8 at steps S2, S3, S8 and S9 are pressure differences between the pump pressures of the closed circuit pumps 35 and 36 detected by the first to fourth pump pressure sensors 90 to 93 and the load pressures of the boom cylinder 1 and the arm cylinder 3 detected by the first to fourth cylinder pressure sensors 94 to 97 (namely, pressure differences across the poppet valves 37*b* and 37*c*, 38*b*, 38*c*, 39*b*, 39*c*, 40*b* and 40*c*) and are computed in accordance with the following expressions.

$$\Delta P1=|\text{pressure of pump pressure sensor 90}-\text{pressure of cylinder pressure sensor 94}| \quad \text{[Expression 1]}$$

$$\Delta P2=|\text{pressure of pump pressure sensor 91}-\text{pressure of cylinder pressure sensor 95}| \quad \text{[Expression 2]}$$

$$\Delta P3=|\text{pressure of pump pressure sensor 90}-\text{pressure of cylinder pressure sensor 96}| \quad \text{[Expression 3]}$$

$$\Delta P4=|\text{pressure of pump pressure sensor 91}-\text{pressure of cylinder pressure sensor 97}| \quad \text{[Expression 4]}$$

$$\Delta P5=|\text{pressure of pump pressure sensor 92}-\text{pressure of cylinder pressure sensor 94}| \quad \text{[Expression 5]}$$

$$\Delta P6=|\text{pressure of pump pressure sensor 93}-\text{pressure of cylinder pressure sensor 95}| \quad \text{[Expression 6]}$$

$$\Delta P7=|\text{pressure of pump pressure sensor 92}-\text{pressure of cylinder pressure sensor 96}| \quad \text{[Expression 7]}$$

$$\Delta P8=|\text{pressure of pump pressure sensor 93}-\text{pressure of cylinder pressure sensor 97}| \quad \text{[Expression 8]}$$

Subsequently, operation of the hydraulic system 200C in the case where the selector valve 38 is sticked in an open state is described.

Referring to FIG. 12, if an operator operates only the boom lever 34*a* within a range equal to or smaller than one half the maximum operation amount to provide an input for driving the boom cylinder 1 to extend, then the information acquisition section 11*a* of the machine body controller 11 receives the operation amount of the boom lever 34*a*. The machine body controlling calculation section 11*b* sets the control command value for the selector valve 37 to opening and sets the control command value for the switching valves 38 to 40 to closing on the basis of the operation amount of the boom lever 34*a* such that only the closed circuit pump 35 is connected to the boom cylinder 1, and sets the pump delivery flow rate command value for the closed circuit pump 35 to a value according to the operation amount of the boom lever 34*a*.

The valve signal outputting section 11*c* outputs an opening signal to the selector valve 37 and outputs closing signals to the switching valves 38 to 40 on the basis of the control command values for the switching valves 37 to 40 from the machine body controlling calculation section 11*b*. The pump signal outputting section 11*d* outputs a control signal to the regulator 35*a* of the closed circuit pump 35 on the basis of the pump delivery flow rate command value from the machine body controlling calculation section 11*b*.

The closed circuit pump 35 delivers hydraulic operating fluid to the line 20 with the delivery flow rate controlled by the regulator 35*a*. It is assumed that the selector valve 38 fails and is sticked in an open state at this time. Here, since the selector valve 37 is open in accordance with the opening signal from the machine body controller 11, by the sticking in an open state of the selector valve 38, the switching valves 37 and 38 (poppet valves 37*b*, 37*c*, 38*b* and 38*c*) are open simultaneously, and the cylinder head 1*a* of the boom cylinder 1 is connected to the cylinder head 3*a* of the arm cylinder 3 through the lines 21, 20, 28 and 25, and the cylinder rod 1*b* of the boom cylinder 1 is connected to the cylinder rod 3*b* of the arm cylinder 3 through the lines 23, 22, 29 and 27. If it is assumed that, in this state, for example, a load in the contraction direction acts upon the boom cylinder 1, then the hydraulic operating fluid of the cylinder head 1*a* of the boom cylinder 1 flows out due to the load and flows into the cylinder head 3*a* of the arm cylinder 3 through the lines 21, 20, 28 and 25. As a result, although the arm lever 34*b* is not operated, the arm cylinder 3 extends.

Referring to FIG. 12, since only the boom lever 34*a* is operated, the first neutral detection switch 62*a* outputs 1 and the second neutral detection switch 62*b* outputs 0.

Referring to FIG. 13, the operation amount detection section 33*a* of the valve device controller 33C detects signals of the first and third neutral detection switches 62*a* and 62*c*. The valve state detection section 33*b* detects pressures of the first to fourth pump pressure sensors 90 to 93 and the first to fourth cylinder pressure sensors 94 to 97.

Referring to FIG. 14, the failure decision section 33*c* executes steps S1 and S2 in this order. Here, since the selector valve 37 is open and besides the selector valve 38 is sticked in an open state, the pressure differences ΔP1 to ΔP4 between the closed circuit pump 35 and the arm cylinder 3 have low values. Accordingly, the failure decision section 33*c* decides at step S2 that the pressure differences ΔP1 to ΔP4 are smaller than the pressure difference threshold value Dth (Yes) and sets the control command value for the first valve fully closing switch 50 to closing at step S4. Thereafter, the failure decision section 33*c* executes steps S7, S8 and S11 in this order and sets the control command value for the second valve fully closing switch 51 to opening. It is to be noted that the pressure difference threshold value Dth is set, for example, on the basis of the pressure loss amount the switching valves 37 to 40 have.

Referring to FIG. 13, the signal generation section 33*d* of the valve device controller 33C outputs a closing signal to the first valve fully closing switch 50 and outputs an opening signal to the second valve fully closing switch 51 on the basis of the control command values for the first and second valve fully closing switches 50 and 51 of the failure decision section 33*c*.

Referring to FIG. 12, the first valve fully closing switch 50 receives the closing signal from the valve device controller 33C and connects the control signal lines from the solenoid valves 37*a* and 38*a* to the open side contact 50*a*. Consequently, since the transmission of a control signal from the machine body controller 11 to the selector valve 37 is disabled, the solenoid valve 37*a* is not driven to the open side and is closed by the spring force to close the selector valve 37 (poppet valves 37*b* and 37*c*). As a result, since the state in which the boom cylinder 1 and the arm cylinder 3 are connected to each other through the lines 21, 20, 28 and 25 and the lines 23, 22, 29 and 27 as a result of the sticking in an open state of the selector valve 38 is cancelled by the disconnection of the lines 21 and 23 and the lines 20 and 22 as a result of the closing of the selector valve 37 (poppet valves 37*b* and 37*c*), the extension of the arm cylinder 3 stops.

According to the present embodiment configured in such a manner as described above, the following advantageous effects are achieved in addition to the advantageous effects of the first embodiment.

In the first embodiment, a first sensor (pilot pressure sensor) is provided for each selector valve. Here, the number of switching valves increases in proportion to the number of closed circuit pumps and the number of hydraulic actuators. Therefore, if the number of closed circuit pumps or hydraulic actuators increases, then the number of first sensor increases significantly and the cost increases. In contrast, in the present embodiment, since it is configured such that a first sensor is provided for each closed circuit pump and each hydraulic actuator, the increasing number of first sensor when the number of closed circuit pumps or hydraulic actuators increases is suppressed, and therefore, the cost can be reduced.

Embodiment 5

A fifth embodiment of the present invention is described principally in regard to differences thereof from the first embodiment.

In the present embodiment, the first and second valve fully closing switches 50 and 51 are controlled only on the basis of pressures of the first to fourth pilot pressure sensors 37*d* to 40*d* the switching valves 37 to 40 have without using the first and second neutral detection switches 62*a* and 62*b* (depicted in FIG. 2) in the first embodiment.

Figure 15:
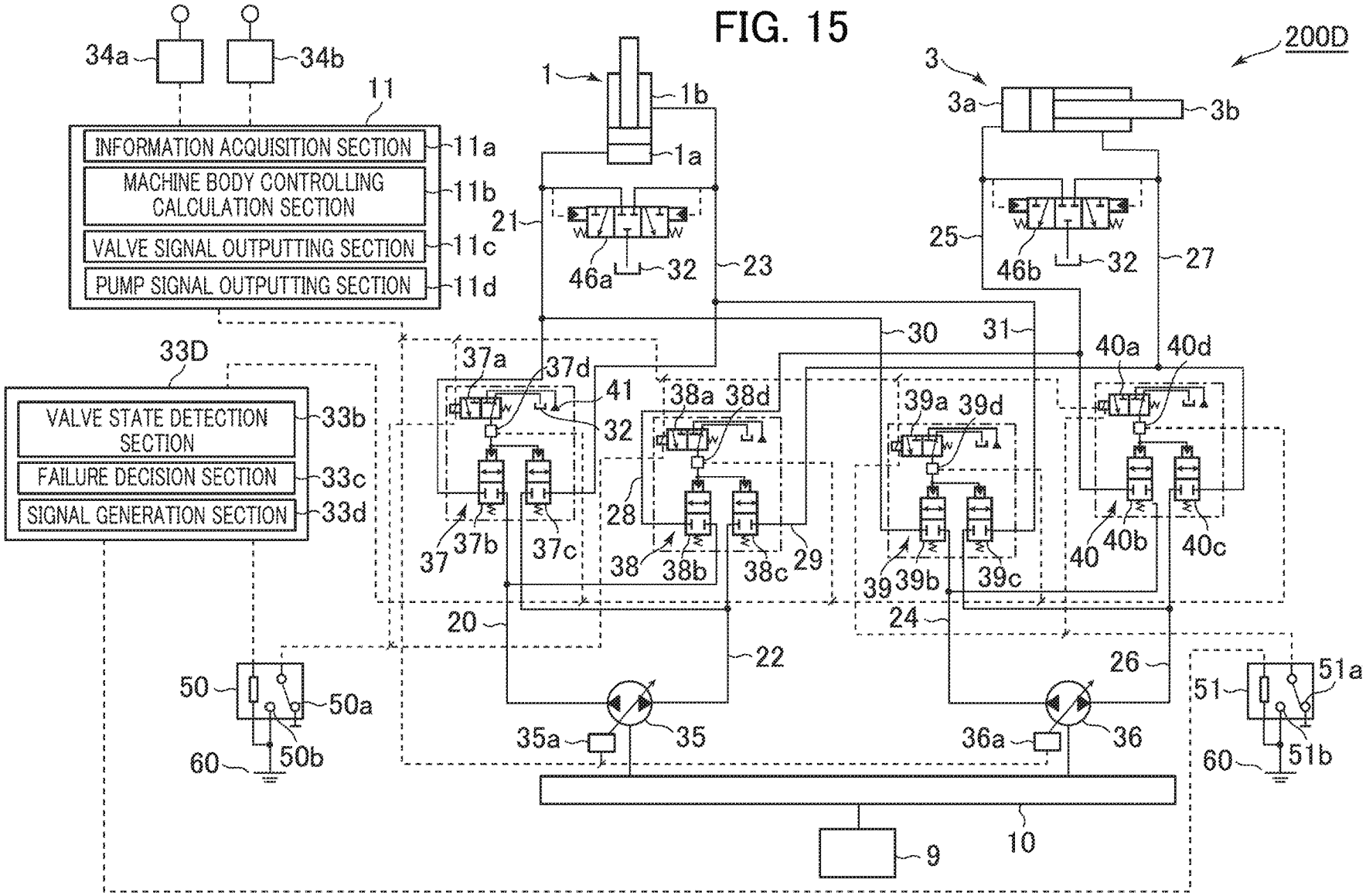
FIG. 15 is a schematic view depicting a configuration of a hydraulic system according to a fifth embodiment of the present invention.

FIG. 15 is a schematic view depicting a configuration of a hydraulic system according to the present embodiment.

Referring to FIG. 15, the hydraulic system 200D does not include the first and second neutral detection switches 62*a* and 62*b* (depicted in FIG. 1) in the first embodiment.

Figure 16:
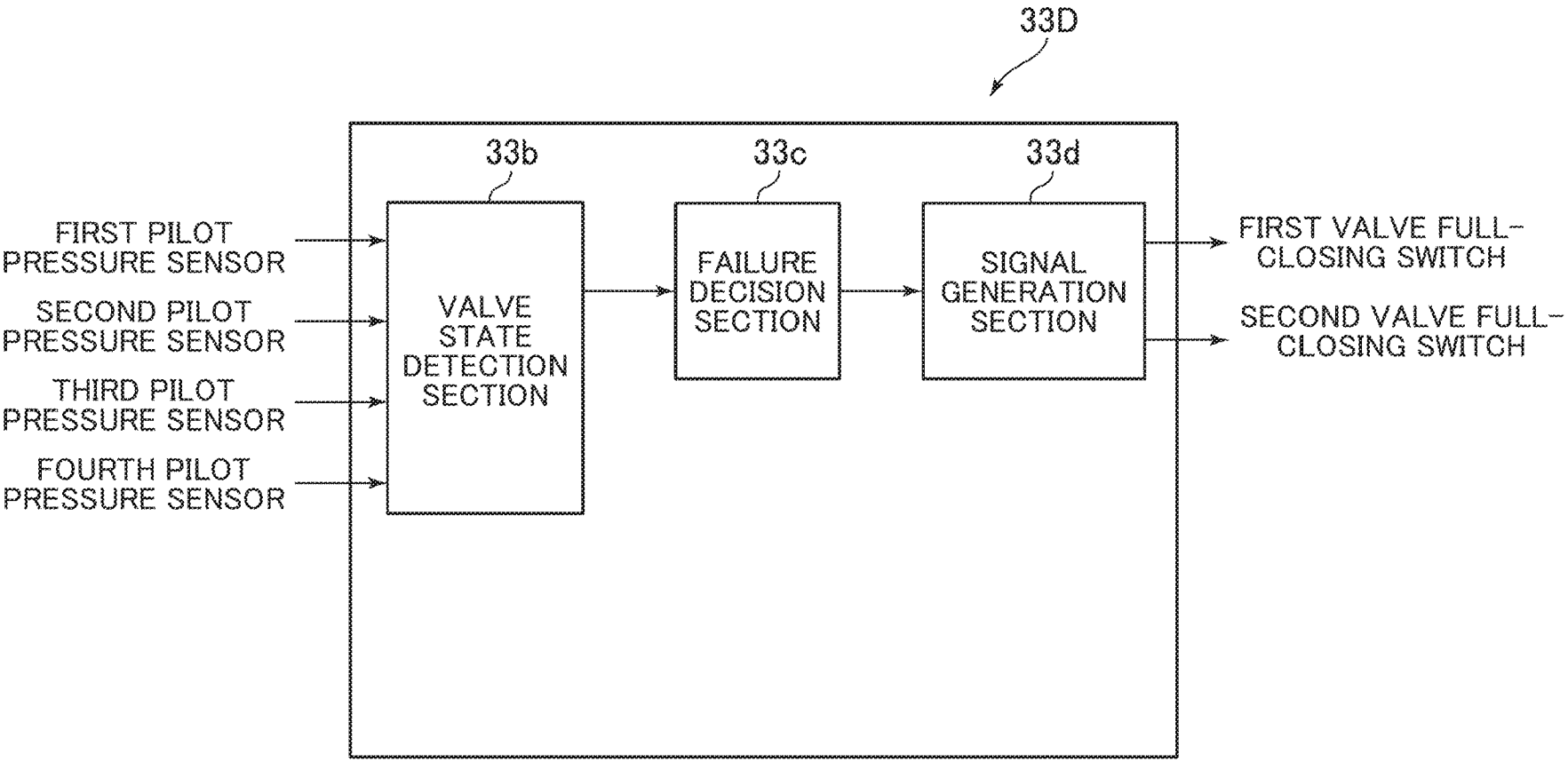
FIG. 16 is a block diagram depicting a configuration of a valve device controller according to the fifth embodiment of the present invention.

FIG. 16 is a block diagram depicting a configuration of a valve device controller 33D according to the present embodiment.

Referring to FIG. 16, since the first and second neutral detection switches 62*a* and 62*b* (depicted in FIG. 1) are omitted in the hydraulic system 200D depicted in FIG. 15, the valve device controller 33D does not include the operation amount detection section 33*a* (depicted in FIG. 3).

Figure 17:
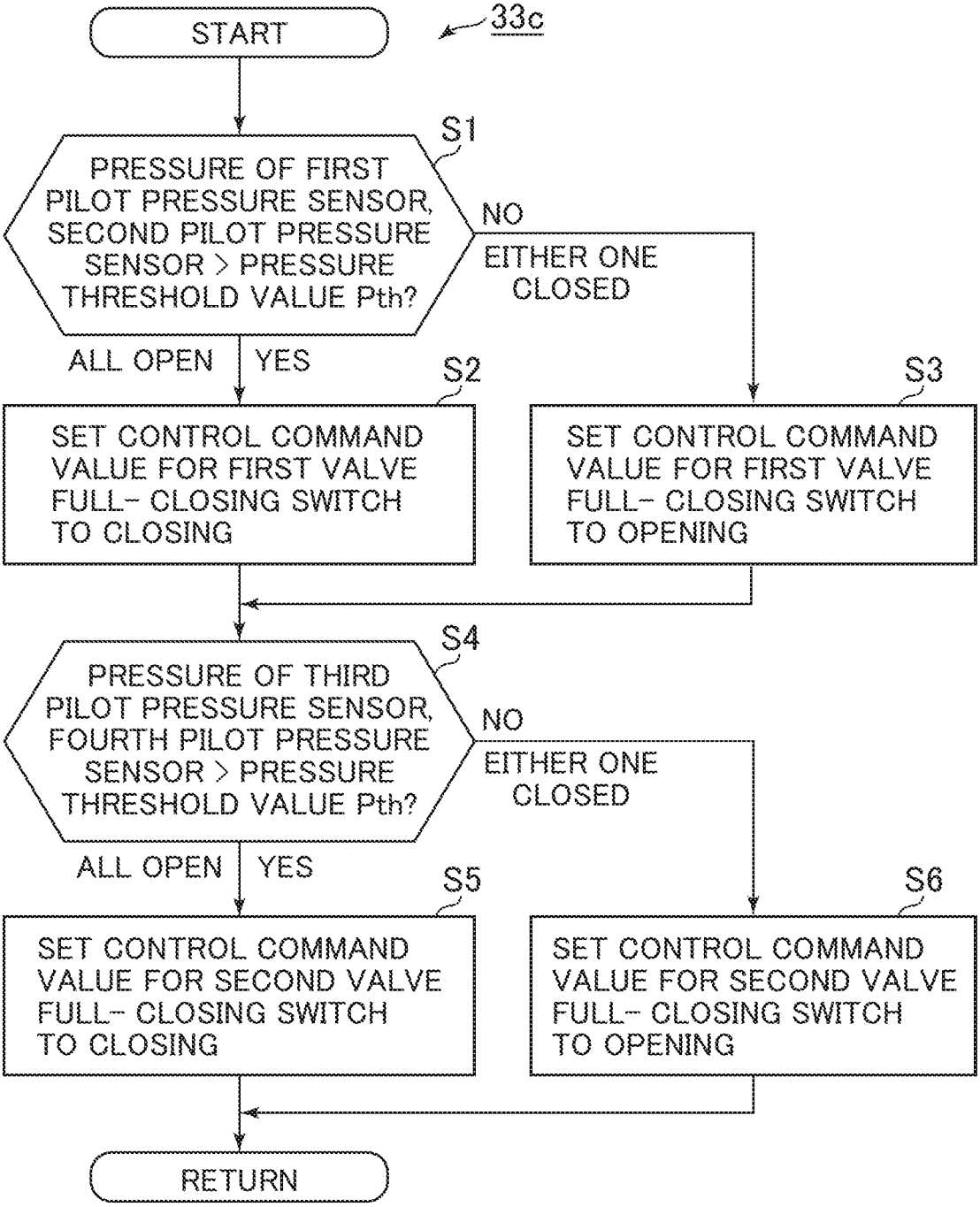
FIG. 17 is a flow chart illustrating processing by a failure decision section of the valve device controller according to the fifth embodiment of the present invention.

FIG. 17 is a flow chart illustrating processing by the failure decision section 33*c* of the valve device controller 33D according to the present embodiment.

Referring to FIG. 17, at step S1, the failure decision section 33*c* decides whether or not the switching valves 37 and 38 are open simultaneously on the basis of the pressures of the first and second pilot pressure sensors 37*d* and 38*d*. In particular, the failure decision section 33*c* decides whether or not the pressure of the first and second pilot pressure sensors 37*d* and 38*d* is higher than the pressure threshold value Pth. In the case where it is decided at step S1 that the switching valves 37 and 38 are open simultaneously (Yes), since unintended operation of the hydraulic actuators 1 and 3 can possibly occur, the control command value for the first valve fully closing switch 50 is set to closing at step S2. On the other hand, in the case where it is decided at step S1 that at least one of the switching valves 37 and 38 is closed (No), since unintended operation of the hydraulic actuators 1 and 3 does not occur, the controlling command value for the first valve full-closing switch 50 is set to opening at step S3.

Now, operation of the hydraulic system 200D in the case where the selector valve 38 is sticked in an open state is described.

Referring to FIG. 15, if the operator operates only the boom lever 34*a* within a range equal to or smaller than one half the maximum operation amount to provide an input for driving the boom cylinder 1 to extend, then the information acquisition section 11*a* of the machine body controller 11 detects the operation amount of the boom lever 34*a*.

On the basis of the operation amount of the boom lever 34*a*, the machine body controlling calculation section 11*b* sets the controlling command value for the selector valve 37 to opening and sets the controlling command value for the switching valves 38 and 40 to closing such that only the closed circuit pump 35 is connected to the boom cylinder 1, and sets the pump delivery flow rate command value for the closed circuit pump 35 to a value corresponding to the operation amount of the boom lever 34*a*.

On the basis of the controlling command values for the switching valves 37 to 40 from the machine body controlling calculation section 11*b*, the valve signal outputting section 11*c* outputs an opening signal to the selector valve 37 and outputs a closing signal to the switching valves 37 to 40. On the basis of the pump delivery flow rate command value from the machine body controlling calculation section 11*b*, the pump signal outputting section 11*d* outputs a control signal to the regulator 35*a* of the closed circuit pump 35.

The closed circuit pump 35 delivers hydraulic operating fluid to the line 20 in accordance with the delivery flow rate controlled by the regulator 35*a*. At this time, it is assumed that the selector valve 38 fails and is sticked in an open state. Here, since the selector valve 37 is open by the opening signal from the machine body controller 11, the switching valves 37 and 38 (poppet valves 37*b* and 38*b*) are open simultaneously from the sticking in an open state of the solenoid valve 38*a* and the cylinder head 1*a* of the boom cylinder 1 is connected to the cylinder head 3*a* of the arm cylinder 3 through the lines 21, 20, 28 and 25 and the cylinder rod 1*b* of the boom cylinder 1 is connected to the cylinder rod 3*b* of the arm cylinder 3 through the lines 23, 22, 29 and 27. If, for example, in this state, a load in the contraction direction acts upon the boom cylinder 1, then hydraulic operating fluid of the cylinder head 1*a* of the boom cylinder 1 flows out due to the load and flows into the cylinder head 3*a* of the arm cylinder 3 through the lines 21, 20, 28 and 25. As a result, although the arm lever 34*b* is in a non-operation state, the arm cylinder 3 extends.

Referring to FIG. 16, the valve state detection section 33*b* of the valve device controller 33D detects a high pressure of the first pilot pressure sensor 37*d* from opening of the solenoid valve 37*a* and detects a low pressure of the third and fourth pilot pressure sensors 39*d* and 40*d* from closing of the solenoid valves 39*a* and 40*a*. Further, the valve state detection section 33*b* detects a high pressure of the second pilot pressure sensor 38*d* from sticking in an open state of the solenoid valve 38*a*.

Referring to FIG. 17, the failure decision section 33*c* decides at step S1 that both of the pressures of the first and second pilot pressure sensors 37*d* and 38*d* are higher than the pressure threshold value Pth (Yes) and sets the control command value for the first valve fully closing switch 50 to closing at step S2. Then at step S4, the failure decision section 33*c* decides that both of the pressures of the third and fourth pilot pressure sensors 39*d* and 40*d* are lower than the pressure threshold value Pth (No) and sets the control command value for the second valve fully closing switch 51 to opening at step S6.

Referring to FIG. 16, the signal generation section 33*d* of the valve device controller 33D outputs a closing signal to the first valve fully closing switch 50 and outputs an opening signal to the second valve fully closing switch 51 on the basis of the control command values for the first and second valve fully closing switches 50 and 51 from the failure decision section 33*c*.

Referring to FIG. 15, the first valve fully closing switch 50 receives the opening signal from the valve device controller 33D and connects the signal lines from the solenoid valves 37*a* and 38*a* to the open side contact 50*a*. Consequently, since a control signal from the machine body controller 11 to the selector valve 37 is disabled, the solenoid valve 37*a* is not driven to the open side and is closed by the spring force to close the selector valve 37 (poppet valves 37*b* and 37*c*). As a result, the state in which the boom cylinder 1 and the arm cylinder 3 are connected to each other through the lines 21, 20, 28 and 25 and the lines 23, 22, 29 and 27 by the sticking in an open state of the selector valve 38 is eliminated as a result of disconnection between the lines 21 and 23 and the lines 20 and 22 by closing of the selector valve 37 (poppet valves 37*b* and 37*c*), and therefore, the extension of the arm cylinder 3 stops.

Also in the present embodiment configured in such a manner as described above, advantageous effects similar to those in the first embodiment are achieved. Further, by the omission of the first and second neutral detection switches 62*a* and 62*b* (depicted in FIG. 2) in the first embodiment, the cost can be reduced.

While the embodiments of the present invention are described in detail above, the present invention is not limited to the embodiments described above but includes various modifications. For example, while, in the embodiments described above, the present invention is applied to a hydraulic excavator, the present invention is not limited to this and can be applied to general construction machinery in which a plurality of hydraulic actuators are driven by a hydraulic closed circuit. Further, the embodiments described above are described particularly in order to facilitate understandings of the present invention, and the present invention is not necessarily limited to the embodiments that include all components described hereinabove. Further, it is possible to add part of the components of a certain embodiment to the configuration of a different embodiment and also it is possible to delete some of the components of a certain embodiment or replace some of the components of an embodiment with some components of a different embodiment.

The invention claimed is:

1. A construction machine comprising:

a plurality of closed circuit pumps;

a plurality of hydraulic actuators;

a plurality of operation levers corresponding to the plurality of hydraulic actuators;

a plurality of switching valves capable of connecting each of the plurality of closed circuit pumps to one of the plurality of hydraulic actuators by closed circuit connection; and a machine body controller that performs open-close control of the plurality of switching valves and flow-rate control of the plurality of closed circuit pumps in response to an operation of the plurality of operation levers;

wherein the construction machine comprises:

a first sensor that detects open-closed states of the plurality of switching valves;

a first compulsory valve closing device that changes over the plurality of switching valves to a closed position irrespective of the open-close control by the machine body controller; and a valve device controller that is configured to, when detecting based on the open-closed states of the plurality of switching valves that one selector valve of the plurality of switching valves is sticked at an open position against a command by the machine body controller, control the first compulsory valve closing device such that other switching valves except the one selector valve, the other switching valves being connected to one closed circuit pump of the plurality of closed circuit pumps, the one closed circuit pump being connected to the one selector valve, are closed.

2. The construction machine according to claim 1, further comprising:

a pilot hydraulic fluid source; wherein each of the plurality of switching valves includes a poppet valve that is provided in one of lines that connect the plurality of closed circuit pumps and the plurality of hydraulic actuators to each other, is biased to a closed side by spring force, and is driven to an open side by a pilot pressure introduced thereto from the pilot hydraulic fluid source, and a solenoid valve that is provided in a line that introduces the pilot pressure from the pilot hydraulic fluid source to the poppet valve, is biased to the closed side by spring force, and is driven to the open side in accordance with a control signal from the machine body controller;

the first sensor includes a pilot pressure sensor that detects a pilot pressure outputted from the solenoid valve included in each of the plurality of switching valves, and when a pressure detected by the pilot pressure sensor is higher than a predetermined pressure, a selector valve corresponding to the pilot pressure sensor among the plurality of switching valves is detected to be open, and when a pressure detected by the pilot pressure sensor is lower than the predetermined pressure, the selector valve corresponding to the pilot pressure sensor among the plurality of switching valves is detected to be open.

3. The construction machine according to claim 1, wherein the first sensor includes a pump pressure sensor that detects a pressure of each of the plurality of closed circuit pumps and a load pressure sensor that detects a pressure of each of the plurality of hydraulic actuators; and when a pressure difference between the pressure detected by the pump pressure sensor and the pressure detected by the load pressure sensor is greater than a predetermined pressure difference, a selector valve included in the plurality of switching valves and disposed in a line that connects one closed circuit pump of the plurality of the closed circuit pumps, the one closed circuit pump corresponding to the pump pressure sensor, and one hydraulic actuator of the plurality of hydraulic actuators, the one hydraulic actuator corresponding to the load pressure sensor, to each other is detected to be closed; and when the pressure difference between the pressure detected by the pump pressure sensor and the pressure detected by the load pressure sensor is smaller than the predetermined pressure difference, the selector valve provided in the line that connects the closed circuit pump corresponding to the pump pressure sensor and the hydraulic actuator corresponding to the load pressure sensor to each other is detected to be open.

4. The construction machine according to claim 1, wherein, when two switching valves of the plurality of switching valves, the two switching valves being connected to one closed circuit pump of the plurality of closed circuit pumps, are detected to be open simultaneously through the first sensor, one selector valve of the two switching valves is detected to be sticked in an open state.

5. The construction machine according to claim 1, further comprising:

a neutral detection switch that detects whether or not the plurality of operation levers are neutral; wherein the valve device controller is configured to detect, when detecting through the plurality of neutral detection switches that all of the plurality of operation levers are neutral and detecting through the first sensor that one selector valve of the plurality of switching valves, the one selector valve being connected to one closed circuit pump of the plurality of closed circuit pumps, is open, that the one selector valve is sticked in an open state, and detect, when detecting through the plurality of neutral detection switches that at least one of the plurality of operation levers is not neutral and detecting through the first sensor that two switching valves of the plurality of switching valves, the two switching valves being connected to one closed circuit pump of the plurality of closed circuit pumps, are open simultaneously, that one selector valve of the two switching valves is sticked in an open state.

6. The construction machine according to claim 2, wherein the first compulsory valve closing device is an electric relay that is provided on a control signal line that connects the machine body controller and a solenoid valve included in each of the plurality of switching valves to each other, the electric relay including switchably a ground side contact for enabling transmission of a control signal and an open side contact for disabling transmission of a control signal; and the valve device controller is configured to, when detecting that the one selector valve is sticked in an open state, switch the electric relay provided on a control signal line connected to a solenoid valve provided in each of the other switching valves except the one selector valve to the open side contact to close the other switching valves.

7. The construction machine according to claim 1, wherein the plurality of hydraulic actuators include a plurality of single rod type hydraulic cylinders, the construction machine further comprising:

a plurality of open circuit pumps whose flow rates are controlled by the machine body controller;

a plurality of assist lines that connect the plurality of open circuit pumps to lines that connect the plurality of closed circuit pumps and cylinder heads of the plurality of single rod hydraulic cylinders to each other;

a plurality of assist valves that are provided on the plurality of assist lines and are open-close controlled by the machine body controller;

a second sensor that detects open-closed states of the plurality of assist valves; and a second compulsory valve closing device that changes over the plurality of assist valves to a closed position irrespective of open-close control of the machine body controller; and the valve device controller is configured to, when detecting based on the open-closed states of the plurality of assist valves that one assist valve of the plurality of assist valves is sticked at an open position against a command from the machine body controller, control the second compulsory valve closing device such that other assist valves except the one assist valve, the other assist valves being connected to one open circuit pump of the plurality of open circuit pumps, the one open circuit pump being connected to the one assist valve, are closed.

8. The construction machine according to claim 1, further comprising:

an undercarriage, an upper swing structure provided swingably on the undercarriage, a swing brake that is controlled by the machine body controller to brake swinging of the upper swing structure, and a compulsory operation device that operates the swing brake irrespective of control by the machine body controller; wherein the plurality of hydraulic actuators include a swing motor that drives the upper swing structure; and the valve device controller is configured to control, when detecting based on the open-closed states of the plurality of switching valves detected by the first sensor that one selector valve of the plurality of switching valves is sticked in an open state, the compulsory operation device such that the swing brake is operated.

* * * * *